US007002288B2

(12) United States Patent
Yonezawa et al.

(10) Patent No.: US 7,002,288 B2
(45) Date of Patent: Feb. 21, 2006

(54) ELECTRON TUBE AND METHOD FOR PRODUCING THE SAME

(75) Inventors: Yoshihisa Yonezawa, Chiba (JP); Yukio Ogawa, Chiba (JP); Hiroaki Kawasaki, Chiba (JP); Yasuhiro Nohara, Chiba (JP); Yoshikazu Iidaka, Chiba (JP)

(73) Assignee: Futaba Corporation, Chiba (JP)

( * ) Notice: Subject to any disclaimer, the term of this patent is extended or adjusted under 35 U.S.C. 154(b) by 0 days.

(21) Appl. No.: 10/076,516

(22) Filed: Feb. 19, 2002

(65) Prior Publication Data

US 2002/0113543 A1 Aug. 22, 2002

(30) Foreign Application Priority Data

Feb. 20, 2001 (JP) ..... 2001-043460
Jun. 28, 2001 (JP) ..... 2001-195827

(51) Int. Cl.
*H01J 1/88* (2006.01)

(52) U.S. Cl. ..... 313/495; 313/271

(58) Field of Classification Search ..... 313/495–496, 313/456, 422, 277, 272, 278, 522, 513–517, 313/271

See application file for complete search history.

(56) References Cited

U.S. PATENT DOCUMENTS 2,683,833 A * 7/1954 Zaphiropoulos ..... 313/429
2,813,772 A * 11/1957 Zaphiropoulos ..... 455/36
3,745,401 A * 7/1973 Stapleton et al. ..... 313/272
3,917,968 A * 11/1975 Di Benedetto et al. ..... 313/272
4,164,683 A * 8/1979 Nakamura et al. ..... 313/496
4,788,472 A * 11/1988 Katakami ..... 313/496
4,812,716 A * 3/1989 Miyama et al. ..... 315/366
4,982,134 A * 1/1991 Aono et al. ..... 313/456
5,179,317 A * 1/1993 Watanabe et al. ..... 313/496
5,192,892 A * 3/1993 Aono et al. ..... 313/422
5,204,583 A * 4/1993 Jeong ..... 313/496
5,235,245 A * 8/1993 Uchimura et al. ..... 313/496
5,300,857 A * 4/1994 Imai et al. ..... 313/491
5,424,607 A * 6/1995 Jeong ..... 313/496
5,568,012 A * 10/1996 Mohri et al. ..... 313/517
5,619,098 A * 4/1997 Toki et al. ..... 313/496
5,621,284 A * 4/1997 Shichao et al. ..... 315/366
5,625,254 A * 4/1997 Hamada ..... 313/493
5,811,920 A * 9/1998 Wada et al. ..... 313/422
5,834,892 A * 11/1998 Kikuchi et al. ..... 313/496
5,949,395 A * 9/1999 Stevens et al. ..... 345/75.2
6,509,693 B1 * 1/2003 Yonezawa et al. ..... 315/169.3
6,710,536 B1 * 3/2004 Yonezawa et al. ..... 313/495
6,717,350 B1 * 4/2004 Yonezawa et al. ..... 313/495
6,798,149 B1 * 9/2004 Yonezawa et al. ..... 315/169.3
6,812,643 B1 * 11/2004 Kawasaki et al. ..... 313/632
6,856,085 B1 * 2/2005 Yonezawa et al. ..... 313/495

FOREIGN PATENT DOCUMENTS

JP 08-007810 1/1996
JP 10-116575 5/1998

* cited by examiner

*Primary Examiner*—Joseph Williams
*Assistant Examiner*—Dalei Dong
(74) *Attorney, Agent, or Firm*—Bacon & Thomas, PLLC

(57) ABSTRACT

An electron tube includes at least one metal film formed on a base, at least one linear member provided above the base, and at least one additional member for connecting said at least one linear member to said at least one metal film. The at least one linear member is connected to the at least one metal film by welding the at least one additional member to the at least one metal film.

19 Claims, 19 Drawing Sheets

ELECTRON TUBE AND METHOD FOR PRODUCING THE SAME

FIELD OF THE INVENTION

The present invention relates to an electron tube equipped with a linear member such as a linear filament, linear spacers, a linear damper, a wire grid or a linear getter (a wire getter), and a producing method thereof; and, more particularly, to a luminescent device, for instance, a vacuum fluorescent tube or a fluorescent display device incorporating therein a linear member installed by using a tension force and a producing method thereof.

BACKGROUND OF THE INVENTION

Referring to FIGS. 14A to 17C, embodiments of the conventional electron tube, for example, the conventional display device will be described. Like reference numerals in FIGS. 14A to 17C represent like parts.

There are shown in FIGS. 14A and 14B a partial top view of a first prior art fluorescent display device and a cross sectional view taken along a line X1—X1 of FIG. 14A, respectively.

As shown, the first prior art display device includes a glass substrate 51, a pair of metallic plates 52, 53 formed on the glass substrate 51, an anchor 54 and a support 55 which are respectively installed at the metallic plates 52, 53 via a pair of mounting portions 541, 551 thereof, and a cathode filament 56. Referring to FIG. 14B, one end of the filament 56 is fixed to the anchor 54 and the other end thereof is fixed to the support 55. In this case, the anchor 54 acts as a resilient member for exerting the tension force on the filament 56 so that it will not hang down and the support 55 functions as a post for supporting the filament 56.

The fastening process of the filament 56 will now be described in detail.

One end of the filament 56 is interposed between a supporting portion of the anchor 54 and a metallic piece 5411, and then the metallic piece is fixed to the supporting portion by a resistance heating welding. The resistance heating welding is carried out by applying an electric current on a pair of heating electrodes (not shown) disposed at bottom of the supporting portion of the anchor 54 and top of the metallic piece. Similarly, the other end of the filament 56 is fixedly joined to the support 55.

When a driving system for applying DC voltage to the filament is employed, a potential gradient develops between the filament and an anode electrode (not shown), and the filament and a grid (not shown) due to a voltage drop of the filament. This induces differential in luminance of both ends of the filament.

Accordingly, in order to reduce influence of the potential gradient as shown in FIG. 15A, a second prior art display device including a plurality of sets of two filaments 661, 662 (one set shown) has been proposed. FIG. 15B illustrates a cross sectional view taken along a line X2—X2 of FIG. 15A. As shown, polarities of the two filaments 661, 662 are provided to be different from each other as will be described later.

The filaments 661, 662 are supported by a first set of an anchor 642 and a support 652 and a second set of another anchor 641 and another support 651, respectively. To be more specific, one filament, e.g., 662 has both ends fixed to a first set, one end to the anchor 641 and the other to the support 651, and the other filament 661 has both ends fixed to a second set, one end to the anchor 642 and the other to the support 652. The anchors 641, 642 are respectively mounted on a glass substrate 61 via their corresponding metallic plates 621, 622, and the supports 651, 652 are respectively mounted on the glass substrate 61 via their corresponding metallic plates 631, 632. Under this condition, a positive potential is applied to the metallic plates 621, 632 and a negative potential is applied to the metallic plates 622, 631.

There are shown in FIGS. 16A and 16B, a partial top view of a third prior art display device including linear spacers 851 (one shown), a damper 852 and filaments 86 (only one is designated by the reference numeral), and a cross sectional view taken along a line X3—X3 of FIG. 16A, respectively.

As shown, one end of the filament 86 is connected to a cathode electrode 82, and similarly the other thereof (not shown) is connected to another cathode electrode (not shown). The filament 86 has a predetermined vertical position sustained by the spacer 851 disposed near its one end and another spacer (not shown) disposed near its other end. The spacer 851 made of a metal line has both ends fixedly attached to spacer supports 831, 841. The spacer supports 831, 841 are fixedly mounted on a glass substrate 81 via an insulating layer 84. The damper 852 made of a metal line is installed between the spacers to prevent the filament 86 from coming into contact with other components mounted at the glass substrate 81. Similar to the spacer 851, the damper 852 has both ends fixed to a pair of damper supports 832, 842. In this prior art, the supports 831, 832 and 841, 842 are respectively corresponding to the anchor 54 and the support 55 shown in FIG. 14A according to the first prior art.

The fastening process of the damper 852 will now be described in detail.

Both ends of the damper 852 are respectively interposed between a supporting portion at the top of the support 832, 842 and a metallic piece 8321, 8421 of each of the damper supports 832, 842 and then the metallic pieces are welded to the supporting portion of its corresponding support by the resistance heating welding. The damper supports 832, 842 are fixedly attached to the anode substrate 81 by using a fritted glass. As above-mentioned, the resistance heating welding is carried out by applying current on a pair of heating electrodes disposed at bottom of the supporting portion and top of the metallic piece corresponding to each of the damper supports 832, 842.

Similarly, both ends of the spacer 851 are also joined to the supports 831, 841.

There are shown in FIGS. 17A to 17B, a partial top view of a fourth prior art display device including wire grids 71 (only one is designated by the reference numeral), and a cross sectional view taken along a line X4—X4 of FIG. 17A, respectively.

As shown, a reference numeral 701 represents an anode substrate made of a glass, a ceramic or the like; 702 a side plate made of, e.g., a glass; 71 wire grids (only one is designated by the reference numeral); 75 anode electrodes (only one is designated by the reference numeral); 761 cathode filaments (only one is designated by the reference numeral); and 762 a support for the cathode filament 761, respectively.

Referring to FIG. 17B, under the condition of applying a predetermined tension force to the wire grid 71 mounted on the jig (not shown), the wire grid 71 is mounted on the spacer 72 made of an insulating material. Next, one end 712 of the wire grid 71 is interposed between the anode substrate 701 and the side plate 702, and similarly the other end thereof is interposed between the anode substrate 701 and another side plate (not shown). Thereafter, the ends of the wire grid 71, the anode substrate 701 and the side plates are connected to each other by using the fritted glass.

Referring to FIG. 17C showing a cross sectional view of a modification of the display device of FIG. 17B, under the condition that the predetermined tension force is exerted on the wire grid 71, both ends of the wire grid 71 are fixedly attached to the spacer 72 by using the fritted glass. The wire grid 71 is connected to grid terminals 714 (one shown) via conductive members 713 (one shown).

In the first display device, the supporting member such as the anchor or the support is of a complicate shape due to the three-dimensional shapes, increasing factory expenses thereof and making a mounting process of the filament difficult. Additionally, the supporting members should have a predetermined strength, setting a limit on the miniaturization of the device. In other words, it is difficult to make the display device thin. Further, since the area for mounting the supporting member and the metallic plates is large, the space excepting for the display area, so-called dead space, is enlarged.

The second display device solves the potential gradient between the filament and the anode electrode and between the filament and the grid, but the mounting space for the supporting member and the metallic plates is about twice as much as that of the first prior art display device. That is, the spatial problem still remains.

Similar to the first display device, the supporting member such as the anchor or the support of the third display device is also of a complicate shape due to three-dimensional shapes, increasing factory expenses thereof and making a mounting process of the spacer and the damper difficult. Further, the supporting member should have a predetermined strength that in turn sets a limit on the miniaturization of the device. On the other hand, it is difficult to make the display device thin.

In the first and/or the third display device, when the filament or the damper is welded by using the resistance heating welding, the welding flames spark and the welding remnants due to the welding flames are attached to other components, deteriorating the display quality. For instance, in the case that the filament or the damper is welded, the welding flames may have direct contact with the fluorescent substance applied to the anode electrode, thereby being stuck thereto, or the welding remnants, which are attached to the anchor or the supporting member in the welding work, may get stripped off in the subsequent processes to be stuck to the fluorescent substance, making the poor display. Further, the welding remnants may develop a short-circuit between the electrodes. On the other hand, when the welding is performed, the portions excepting for the welding points are also heated. This results in the anchor and the supporting member or the like being expanded, developing cracks in the anode substrate.

The fluorescent radiation device such as the fluorescent display device is fabricated by installing the damper, the spacer or the wire grid and then performing the heating process several times. For example, the fritted glass is used for fixedly attaching the supporting member in the third prior art and the wire grid in the fourth prior art. Therefore, the heating temperature in the steps thereafter should be maintained at a lower level than the melting point of the fritted glass. However, it is cumbersome to maintain the foregoing temperature and sometimes the fritted glass is melted to deviate the initial positions of the members fixed thereby. Moreover, since the components constituting the display device should be made of the materials which can undergo the heating process at a temperature below the melting point of the fritted glass, the applicable materials are limited.

SUMMARY OF THE INVENTION

It is, therefore, an object of the present invention to provide a display device formed by forming a metallic additional member on a linear member; and by welding a cathode linear member, e.g., a cathode filament to cathode electrodes of a metallic layer/plate fixedly attached on a base, e.g., a glass substrate; cathode supporting auxiliary linear supports such as a cathode spacer, a cathode damper or the like on its corresponding fixing metallic layer/plate formed on the base; a grid linear member, e.g., a wire grid, on grid electrodes fixedly formed on the base; grid supporting auxiliary linear supports on their corresponding fixing metallic layer/plate fixedly attached on the base; and getter linear members, e.g., a wire getter on its corresponding fixing metallic layer/plate.

Another object of the present invention is to provide a display device including a linear member such as a wire grid, a filament or a damper, the fastening of the linear member being performed under the condition that a tension force is applied thereto.

Still another object of the present invention is to provide a display device employing a diffusion welding (for example, a wire bonding, an ultrasonic wire bonding and an ultrasonic bonding) or a solid-state welding (for example, an ultrasonic welding) in the welding of a linear member included therein.

In accordance with a preferred embodiment of the present invention, there is provided an electron tube including:

at least one metal film/layer formed on a base;

at least one linear member provided above the base; and at least one additional member for connecting said at least one linear member to said at least one metal film/layer, wherein said at least one linear member is connected to said at least one metal film/layer by welding said at least one additional member to said at least one metal film/layer.

In accordance with another preferred embodiment of the present invention, there is provided a method for producing an electron tube comprising the steps of forming at least one metal film/layer on a base;

forming at least one additional member on at least one linear member; and fixing the at least one linear member to the at least one metal film/layer by ultrasonic-bonding the at least one additional member to the at least one metal film/layer.

BRIEF DESCRIPTION OF THE DRAWINGS

The above and other objects and features of the present invention will become apparent from the following description of the preferred embodiments given in conjunction with the accompanying drawings, wherein.

DETAILED DESCRIPTION OF THE PREFERRED EMBODIMENTS

Figure 1A:
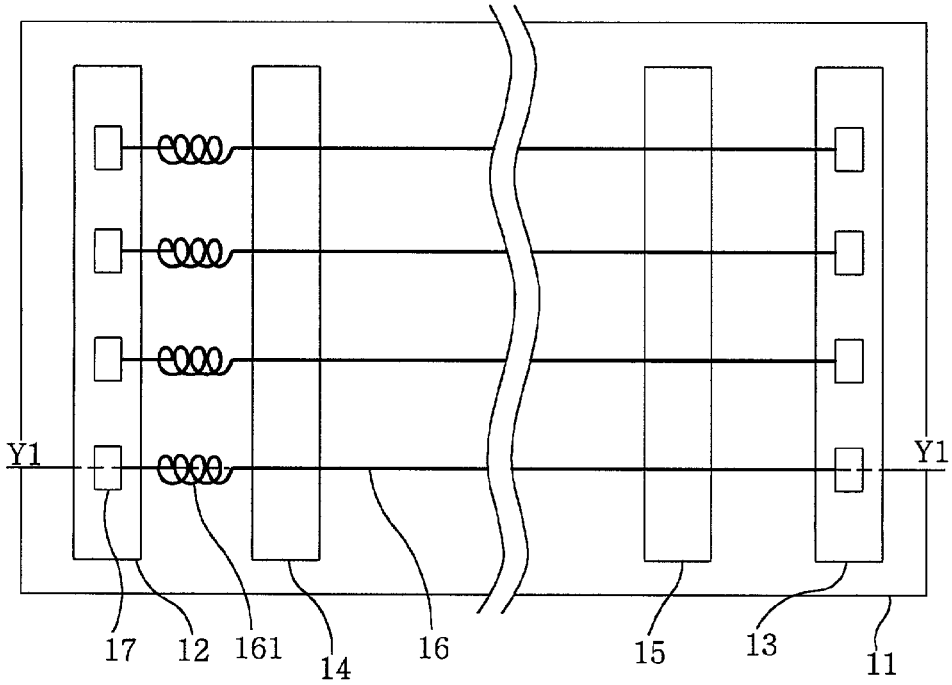
FIGS. 1A and 1B illustrate a partial top view of a filament mounting part of a display device in accordance with a first preferred embodiment of the present invention, and a cross sectional view taken along a line Y1—Y1 of FIG. 1A.

Referring to FIGS. 1 to 13, preferred embodiments of the present invention will be described. Like reference numerals in FIGS. 1 to 13 represent like parts.

Figure 1B:
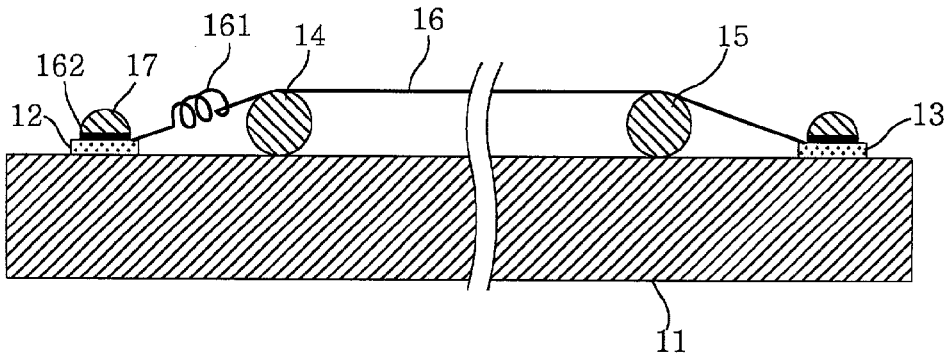

There are shown in FIGS. 1A and 1B, a partial top view of a filament mounting part of a display device in accordance with a first preferred embodiment of the present invention, and a cross sectional view taken along a line Y1—Y1 of FIG. 1A, respectively.

As shown, a reference numeral 11 represents a base or a substrate made of an insulator, e.g., a soda lime glass or a ceramic or the like; reference numerals 12, 13 cathode electrodes of metallic layer (or metallic film), made of e.g., Al and extracted to outside via cathode wirings (not shown) or cathode terminals (not shown); 16 cathode filaments (only one is designated by the reference numeral) made of, e.g., W or Re—W alloy; 14, 15 spacers made of an insulator, e.g., glass fiber, for defining the vertical position of the filament 16; 161 a tension force applying member for exerting a predetermined tension force on the filament 16, e.g., a coil portion of the filament 16; 162 one end of the filament 16; and 17 welded pieces as metallic additional member (only one is designated by the reference numeral) made of, e.g., Al, for welding the filaments to its corresponding cathode electrodes. The glass substrate 11 between the spacers 14, 15 is provided with an anode electrode (not shown) having a fluorescent substrate (e.g., ZnO:Zn) applied thereon and wirings (not shown) extended to outside opposite to the filament 16 installed thereat, for extracting the anode electrode to outside.

One end 162 of the filament 16 is coupled to one of the Al thin film, e.g., 12 to be interposed between the Al piece 17 and the Al thin film 12. The Al piece 17 is welded to the Al thin film 12 by using, e.g., an ultrasonic bonding. Similarly, the other end of the filament 16 is connected to another Al thin film 13. Otherwise, the filament is coupled to a pair of Al films by using metallic pieces instead of the metallic wire (see FIG. 4A). In this case, each of the Al wires is cut to a plurality of metallic pieces by a suitable cutter. Otherwise, Al thin film 12, 13 may be formed on a substrate 11 via insulating film/layer.

The term the cathode electrodes 12, 13 used here represent electrodes to which both end of the filaments 16 are connected respectively. Further, the term cathode terminal or cathode wiring refers to the terminal or the wiring whose one end is connected to the cathode electrode 12 or 13 and the other end thereof is extracted to outside, acting as a power feeding point.

The substrate 11 and the Al thin film are respectively designed to have thickness of about 1.1 mm and about 1.2 $\mu$m. And, the Al piece 17, the filament 16 and the spacers 14, 15 are respectively designed to have a diameter of about 0.1 mm and more, preferably 0.5 mm, about 15 $\mu$m (0.64 MG) and about 1.0 mm. Further, the welding is carried out under the condition of the ultrasonic output of 15 W, the load of a wedge tool of 1100 g and the bonding time of 250 m sec. In this embodiment, it is possible to obtain the binding strength of an approximately 20 N which is much stronger than 0.5 N of the line strength of the filament 16.

Although the above discussions refer to a situation where the welded pieces and the cathode electrodes are made of Al, these members may be made of a material suitable for welding or bonding work, e.g., copper, gold, nickel, niobium, vanadium, silver or the like. Further, the pieces (or metallic additional members) and the cathode electrodes (the metallic films) are preferably made of similar metallic material, e.g., Al and Al alloy, and most preferably made of the same metallic material in point of binding strengths, e.g., Al and Al, but may be made of different materials from each other.

The plurality of pieces is used for welding (ultrasonic-bonding) the filament to the cathode electrodes, but a metallic wire may be employed. In this case, the welding wire (the bonding wire) welds one end of the filament to the cathode electrode by using ultrasonic wire bonding and then is cut to form electrically independent pieces.

In this embodiment, the cathode electrodes are formed in the thin films but may be formed in the thick film including a metal material, and the welded piece including a metal material has a round section but may have a polygonal section or the like or be flat.

In this embodiment, one outer end of the filament is disposed at one outer end of the welded piece, but may be disposed at inner position or outside position of the welded piece.

The filament can be welded by using a laser or a resistance heating welding. In this case, tungsten constituting the filament or carbonate coated on the filament is evaporated by the heat to be attached on the fluorescent substance of the anode, generating a poor luminescence, or the Al thin film gets damaged by the heat. But, it is found that, when the ultrasonic bonding is employed, it is possible to prevent the above-mentioned problems. For this reason, the ultrasonic bonding is valuable and more particularly suitable for welding a linear member such as the filament to the metallic thin film.

In order to have the fluorescent display device miniaturized, the cathode electrodes of the Al thin film should be formed of a narrow width, but this will decrease the binding strength between the Al thin film and its corresponding Al wire or Al piece. Particularly, in the case of employing the laser or the resistance heating welding, the electric resistance becomes greater due to a chemical change in the bonding surfaces. On the other hand, in the case of ultrasonic bonding, it is found that these problems are prevented.

Figure 2A:
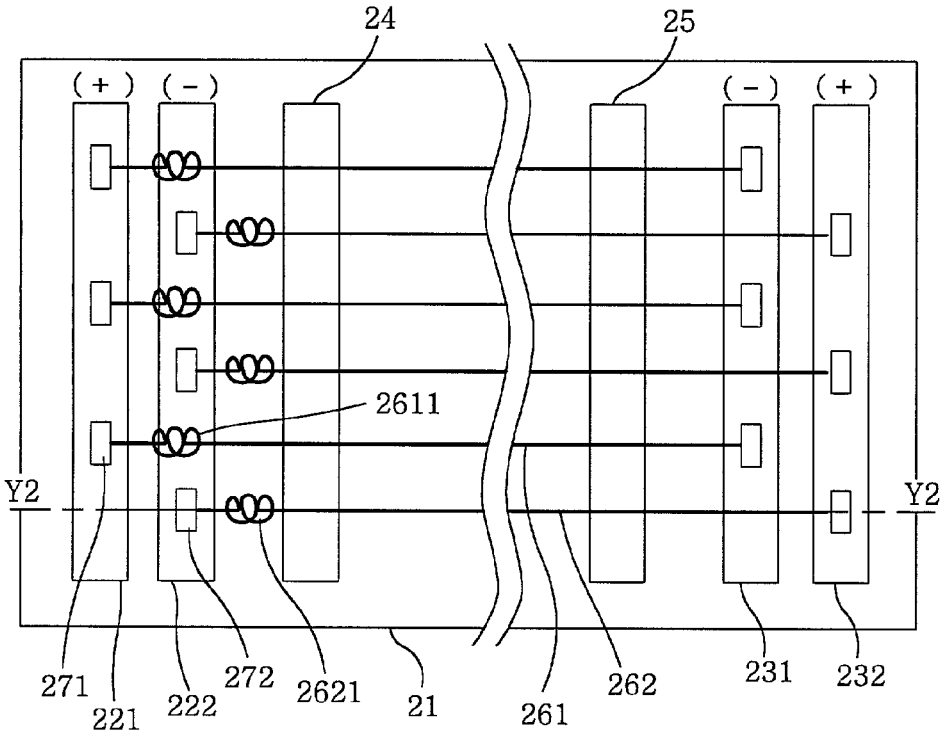
FIGS. 2A and 2B depict a partial top view of a filament mounting part of a display device in accordance with a second preferred embodiment of the present invention and a cross sectional view taken along a line Y2—Y2 of FIG. 2A, respectively.
Figure 2B:
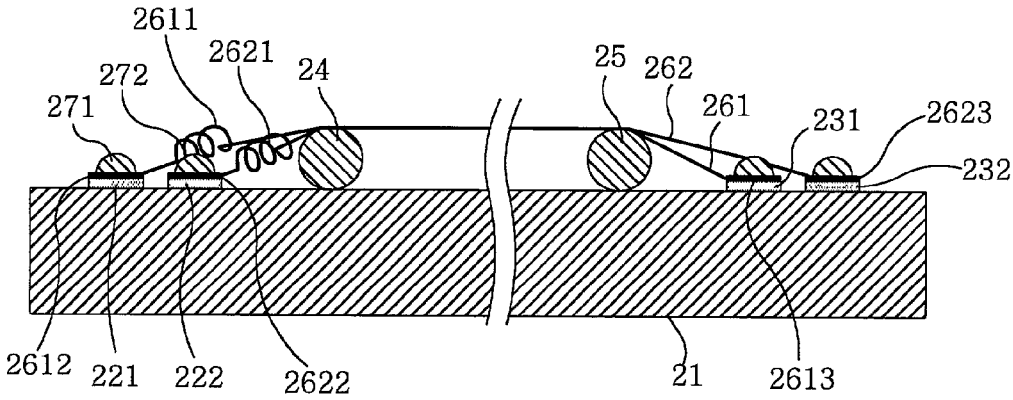

There are shown in FIGS. 2A and 2B, a partial top view of a filament mounting part of a display device in accordance with a second preferred embodiment of the present invention and its cross sectional view taken along a line Y2—Y2 of FIG. 2A, respectively.

As shown, a reference numeral 21 represents a glass substrate as a base; reference numerals 221, 222, 231, 232 cathode electrodes formed on the glass substrate 21 and made of metal layers (metal films), e.g., Al thin film; 24, 25 spacers made of an insulator (e.g., glass fiber); 261, 262 a first and a second cathode filament; 2611, 2621 a tension force applying member, e.g., coil portions of the filaments 261, 262; 2612, 2622 one side ends of the respective filaments 261, 262; and 271, 272 a first and a second metallic piece made of, e.g., Al. The first and the second Al piece 271, 272 (or, metallic additional members) for welding their corresponding filaments 261, 262 on its corresponding cathode electrode pairs 221, 231 and 222, 232, respectively.

To be more specific, the one end 2612 of the first filament 261 is interposed between the first metallic piece 271 and its corresponding Al thin film 221 and then welded to Al thin film 221 by using the ultrasonic bonding; and the one end 2622 of the second filament 262 is similarly interposed between the second metallic piece 272 and its corresponding Al thin film 222 and then welded to the Al thin film 222 by same welding. Instead of the metallic pieces 271, 272, the metallic wires can be employed (see FIG. 4A). Similarly, the other side ends 2613, 2623 of the filaments 261, 262 are respectively welded to the Al thin films 231, 232. The spacers 24, 25 are installed between the ends 2613, 2622 of the filaments 261, 262 to define a vertical position of the filaments 261, 262.

In the second embodiment, it is considerable that a filament mounting part includes a first set of the first filament 261 and its corresponding AL thin films 221, 231, and a second set of the second filament 262 and its corresponding the AL thin films 222, 232. The first and the second filament 261, 262 are respectively installed at the base 21 by using their corresponding sets of AL thin films 221, 231 and 222, 232.

In such a structure, by applying the positive and the negative potentials to a first pair of Al thin films 221, 232 and a second pair of Al thin film 222, 232 respectively, the first and the second pair of Al thin films have an adverse potential gradient to each other. For that reason, even if a driving system of applying DC voltage to the filaments is employed, approximately uniformed potentials are maintained between the filaments and the anode electrode and the filaments and the grid regardless of their locations. Accordingly, the display device has an approximately uniformed luminance at the front thereof.

In such a filament mounting part, the current flowing in each of the Al thin films becomes a half of that of the first embodiment. This allows the width of the Al thin films to be reduced into a half thereof. Further, a gap between the Al thin films is approximately several tens of $\mu$m and therefore is negligible. Consequently, the area for forming the Al thin films is substantially identical to that of the first embodiment. Additionally, even if the widths of the Al thin films are narrow, the ultrasonic bonding is employed, thereby eliminating damages due to the heat, e.g., breaking the Al thin films.

Moreover, since only two spacers 24, 25 are required for maintaining the vertical position of the filaments 261, 262, there is no reason for increasing the number of the spacer compared with the first embodiment.

Figure 3A:
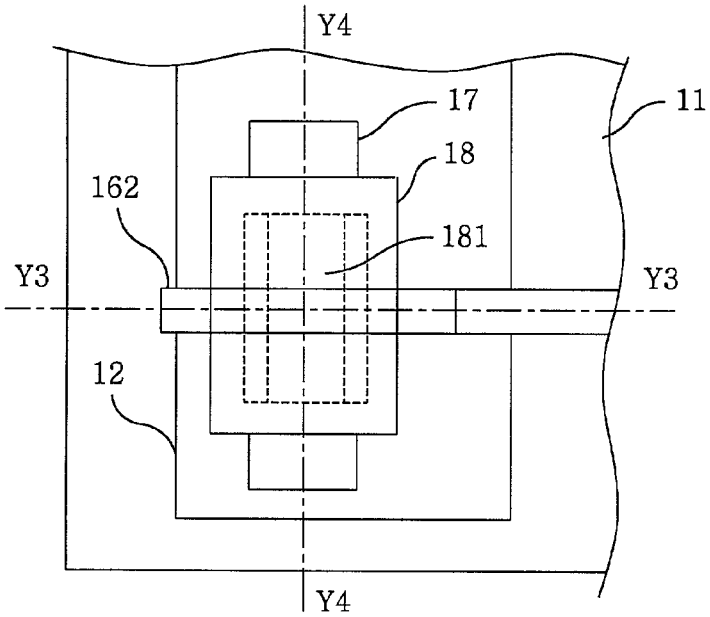
FIGS. 3A to 3C present a view for setting forth how to weld the Al piece of FIG. 1A, a cross sectional view taken along a line Y3—Y3 of FIG. 3A, and a cross sectional view taken along a line Y4—Y4 of FIG. 3A, respectively.
Figure 3B:
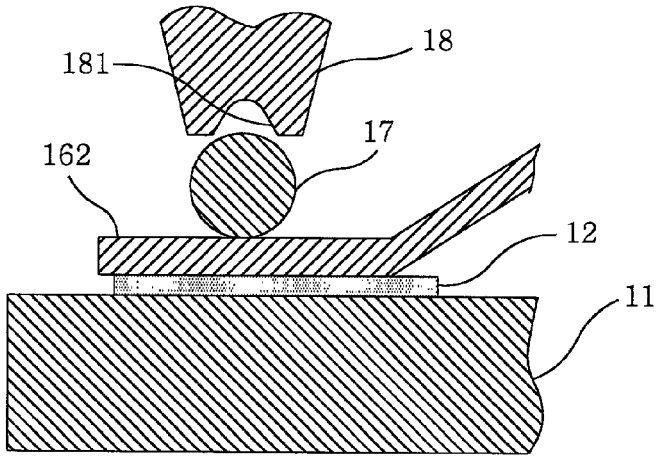
Figure 3C:
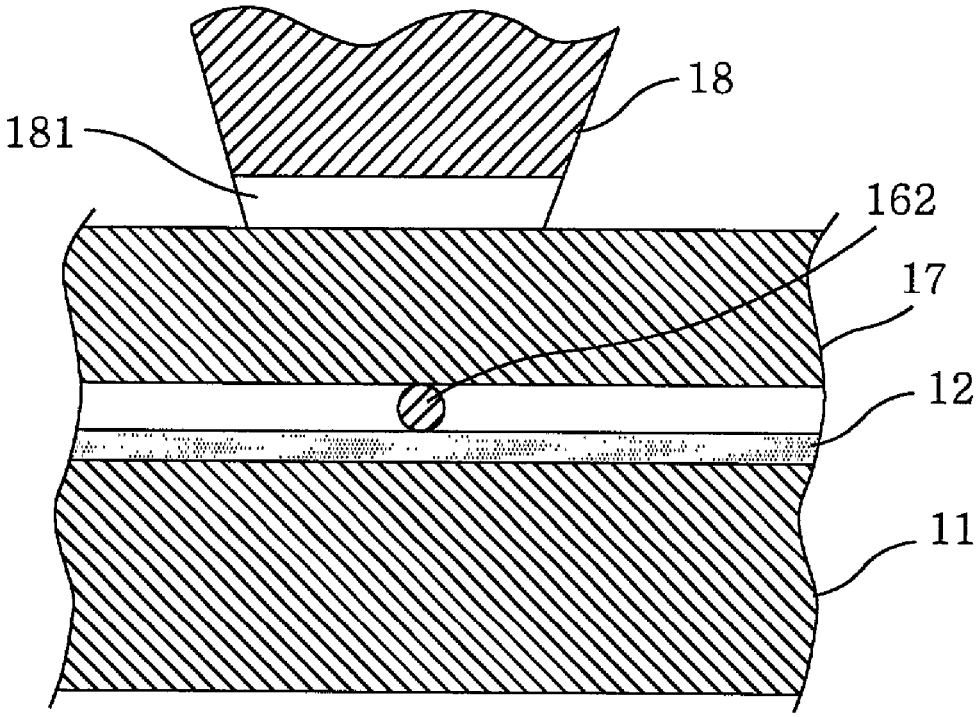

There are shown in FIGS. 3A to 3C a view for setting forth how to weld the Al piece 17 of FIG. 1A, a cross sectional view taken along a line Y3—Y3 of FIG. 3A, and a cross sectional view taken along a line Y4—Y4 of FIG. 3A, respectively.

As shown, a reference numeral 18 represents a wedge tool having, e.g., a V-shaped groove 181.

After one end 162 of the filament 16 and the Al piece 17 are successively overlapped on the Al thin film 12 formed on the glass substrate 11, the groove 181 of the wedge tool 18 is aligned with the longitudinal direction of the Al piece 17. Under this condition, when the wedge tool 18 is driven by the ultrasonic waves, the Al piece 17 is welded to the Al thin film 12 to envelope the end 162 of the filament 16. If, instead of the Al pieces, the Al wire is employed, the Al wire is cut by a cutter (not shown) after the welding.

The wedge tool may be of various shapes and the known ultrasonic bonding device may be employed for welding the metallic pieces.

Figure 4A:
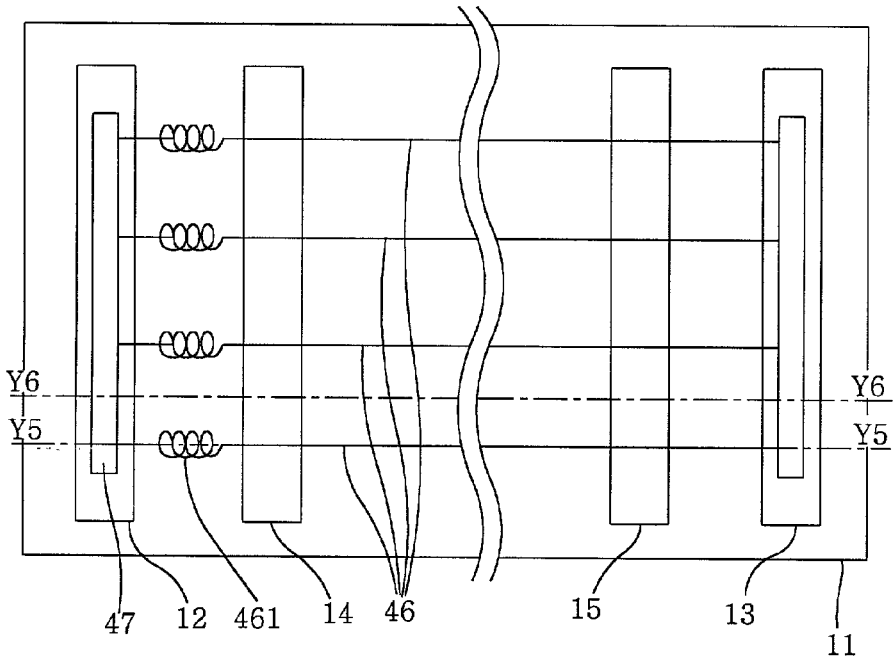
FIGS. 4A to 4C represent a partial top view of a filament mounting part of a display device in accordance with a third preferred embodiment of the present invention, a cross sectional view taken along a line Y5—Y5 of FIG. 4A, and a cross sectional view taken along a line Y6—Y6 of FIG. 4A, respectively.
Figure 4B:
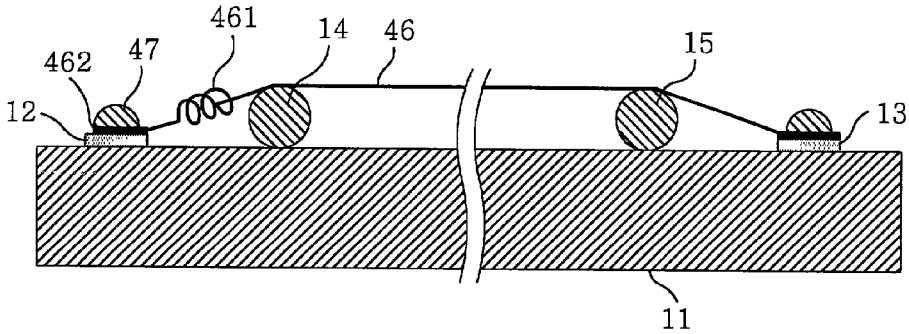
Figure 4C:
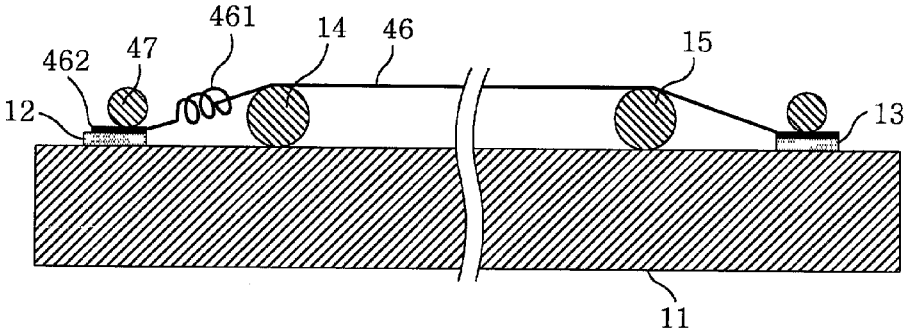

There are shown in FIGS. 4A to 4C, a partial top view of a filament mounting part of a display device in accordance with a third preferred embodiment of the present invention, a cross sectional view taken along a line Y5—Y5 of FIG. 4A, and a cross sectional view taken along a line Y6—Y6 of FIG. 4A, respectively.

The third embodiment is similar to the first embodiment, excepting for an Al wire 47.

Referring to FIGS. 4A and 4B, each one end 462 (one shown) of filaments 46 having coiled portions 461 is interposed between the Al thin film 12 and the Al wire 47 and then is welded to the Al thin film 12 by, e.g., the wedge tool 18. Similarly, the other end (not shown) of each of the filaments 46 is welded to the Al thin film 13.

In this embodiment, the ends 462 of filaments 46 are capable of being welded to the Al thin film 12 by using its corresponding one Al wire 47. That is, when the filaments 46 are welded to the film 12, it is unnecessary to cut the Al wire into a plurality of pieces as illustrated in the first embodiment. Accordingly, the welding process is simple. The Al wire 47 is also usable as a cathode electrode, and therefore, even when the Al thin films 12, 13 get damaged during the welding process, there will be no problems in feeding power to the filaments.

Additionally, when the current capacity of the Al thin films 12, 13 is insufficient, it is possible for the Al wire 47 to compensate for the insufficient amount thereof. Consequently, the widths of the Al thin films 12, 13 can be reduced by as much as the area corresponding to the current amount compensated by the Al wire 47.

On the other hand, since, when the wedge tool having a relatively wide width is used for welding the Al wire 47, the ends 462 of the filaments 46 are simultaneously welded to the Al thin film 42, the installation of the filaments is simple and therefore it is possible to shorten the welding time.

In the present invention, in order to connect the filaments to the thin film cathode electrodes, the anode wirings, and the cathode electrodes (whether it performs double duty as the cathode wirings or the separate cathode wirings are formed) and the anode electrode are firstly formed on the glass substrate. Next, the fluorescent substrate is applied on the anode electrode and then the insulating spacers are installed at the glass substrate. Subsequently, the ends of the filaments are connected to the cathode electrodes and then are covered by the welded additional member such as the metallic wires or the metallic pieces. Thereafter, the welded members are welded to the thin film cathode electrodes by using the wedge tool performing the ultrasonic bonding. That is, the filaments are welded to the thin film cathode electrodes under the condition of being fixedly positioned between the welded members and the thin film cathode electrodes. On the other hand, plane grids may be provided around the anode electrodes.

The welded metallic wires may be made of, e.g., copper, gold, nickel, a niobium, vanadium or silver and have various shapes, e.g., a circular, polygonal shape in a section or a flat shape. Further, instead of employing the metallic wires as the welded members, it is possible to use a plurality of separate metallic pieces.

Figure 5A:
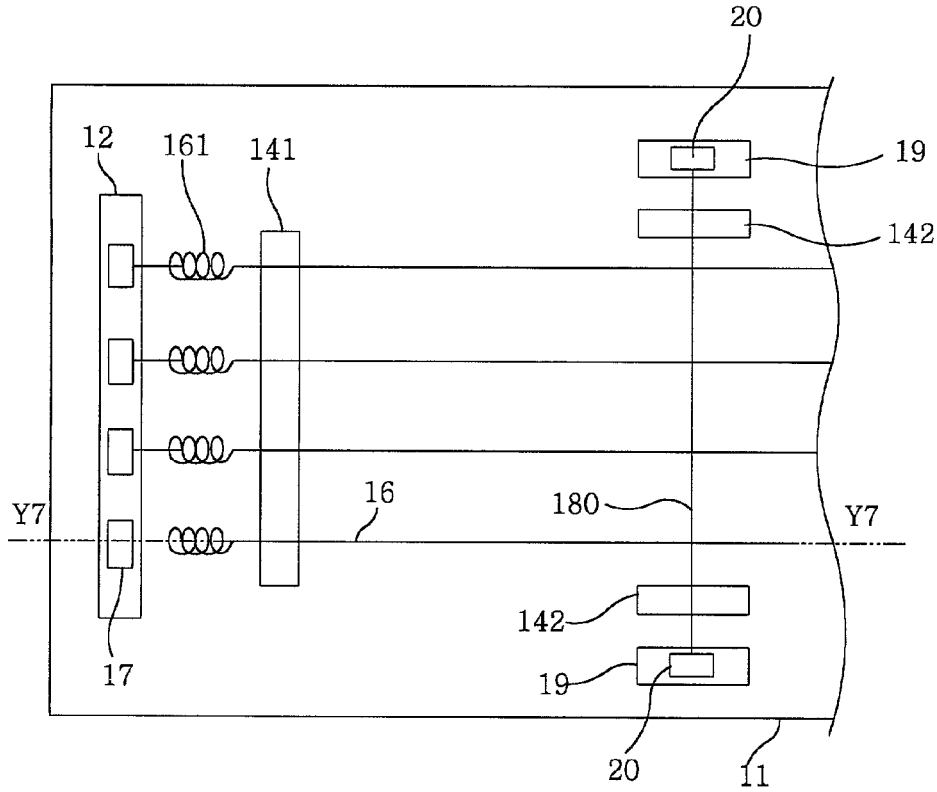
FIGS. 5A to 5C describe a partial top view of a damper mounting part included in a display device in accordance with a fourth preferred embodiment of the present invention, a cross sectional view taken along a line Y7—Y7 of FIG. 5A, and a cross section view of a modification of FIG. 5B, respectively.
Figure 5B:
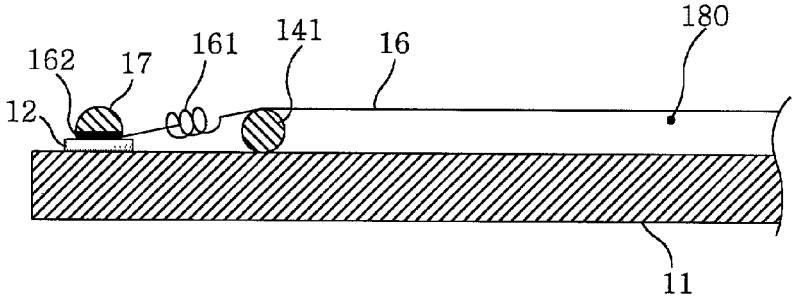
Figure 5C:
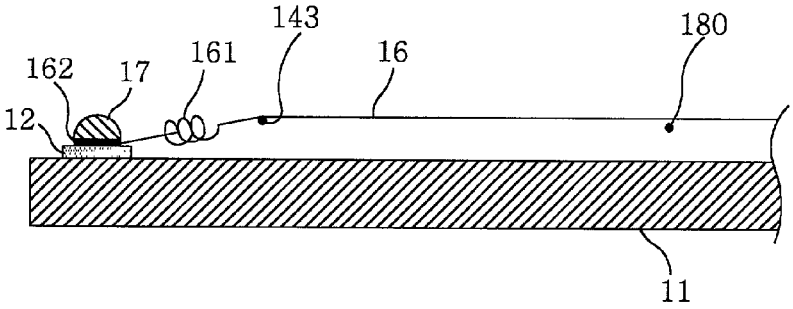

There are shown in FIGS. 5A and 5B, a partial top view of a damper mounting part included in a display device in accordance with a fourth preferred embodiment of the present invention and a cross sectional view taken along a line Y7—Y7 of FIG. 5A, respectively. FIG. 5C shows a cross sectional view of a modification of FIG. 5B. The fourth embodiment is similar to the first embodiment excepting for further including the damper mounting part.

Referring to FIGS. 5A and 5B, the damper mounting part in accordance with the fourth embodiment includes a linear metallic damper 180 as a cathode supporting auxiliary member, a pair of Al thin films 19 on the glass substrate 11 and a pair of Al wires 20 on the Al thin films 19. The damper 180 is made of, e.g., W, Mo or stainless, and both ends thereof are respectively interposed between two pairs of the Al thin films 19 and the Al wires 20 and then are secured to its corresponding Al thin film 19 by welding its corresponding Al wire 20. In this case, the Al thin films 19 and the Al wires 20 for the damper 180 are respectively corresponded to the Al thin film 12 and the Al wire 17 for the filament 16. The damper 180 maintains its vertical position by using spacers 142 installed between the Al thin films 19. In this case, the damper spacer 142 is made of an insulator, e.g., glass fiber or a conductive material, e.g., metal line, and is corresponded to the filament spacer 141.

The damper spacer 142 has a smaller diameter by as much as the diameter of the damper 180 than that of the filament spacer 141, but may have an identical diameter to that of the filament spacer 141. On the other hand, since, when the filament 16 is always in contact with the damper, the radiant heat of the filament 16 increases at the contact part. As a result, it is preferable that the damper spacer 142 may have a smaller diameter than that of the filament spacer 141. To be more specific, preferably, the damper spacer 142 has a smaller diameter than that of the filament spacer 141 in such a way that, only when the filament 16 is vibrating, it will contact with the damper 180.

The damper 180 may be made of an identical material with the filament spacer 141. In this case, the damper 180 is capable of being installed at the glass substrate 11 as the filament spacer 141.

FIG. 5C presents a modification of FIG. 5B in which a filament spacer 143 similar to the damper 180 is included. In this case, similarly to the installation of the damper 180, the ultrasonic bonding is usable in the installation of the filament spacer 143.

Such a damper and/or a filament spacer can be employed in the second and the third embodiment.

The damper 180 and the filament spacer 143 are described as the cathode supporting auxiliary linear member (the filament spacer, the filament damper), but can be used for a grid supporting auxiliary linear member for a grid (see FIGS. 6A, 6B) (a wire grid spacer, a wire grid damper) as will be described later.

Figure 6A:
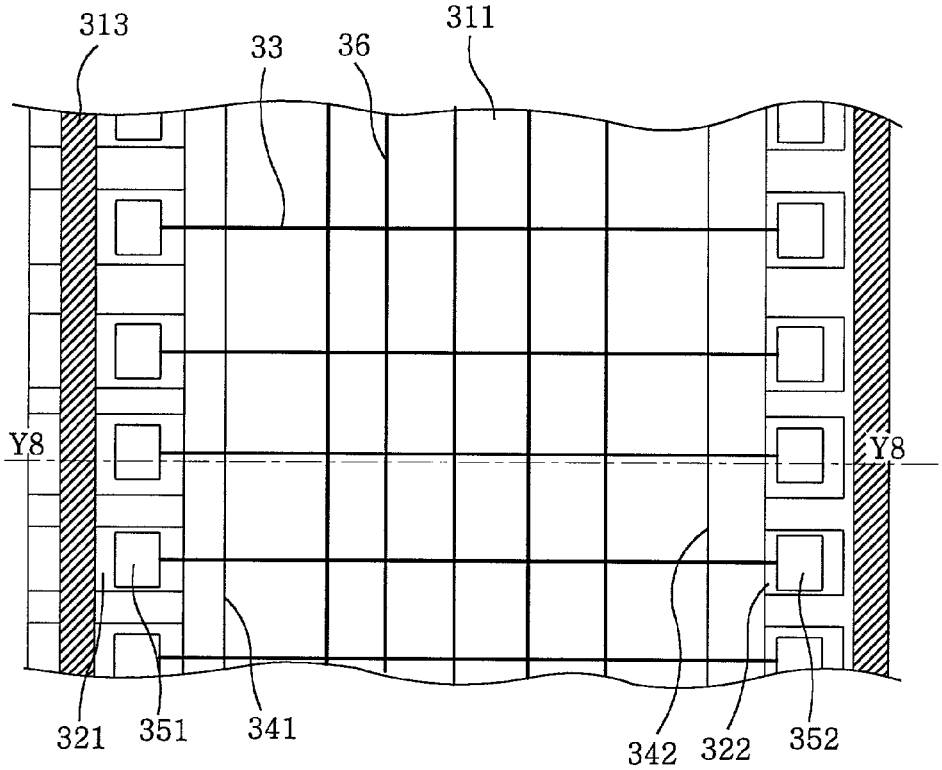
FIGS. 6A and 6B set forth a partial top view of a filament mounting part included in a display device in accordance with a fifth preferred embodiment of the present invention and a cross sectional view taken along a line Y8—Y8 of FIG. 6A, respectively.
Figure 6B:
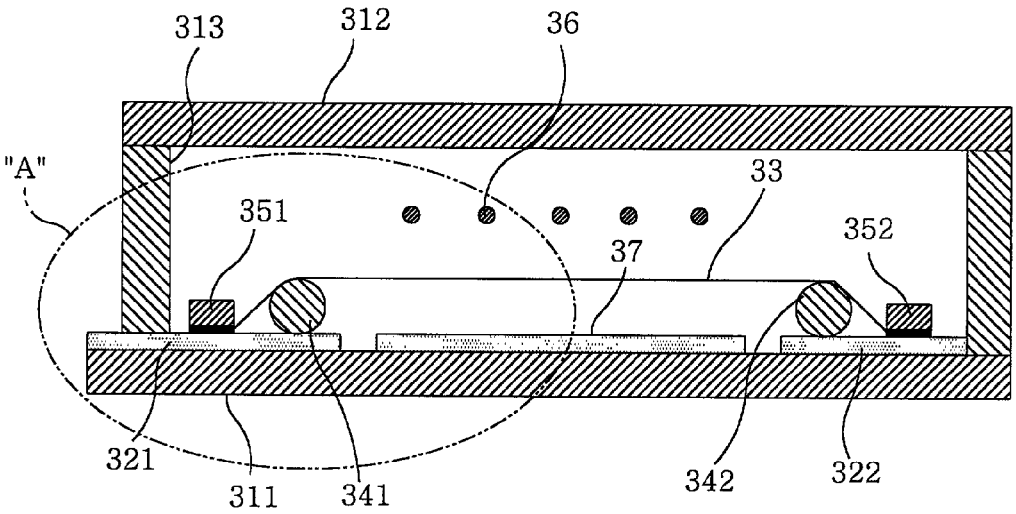

There are shown in FIGS. 6A and 6B, a partial top view of a filament mounting part included in a display device in accordance with a fifth preferred embodiment of the present invention and a cross sectional view taken along a line Y8—Y8 of FIG. 6A, respectively. This embodiment includes a wire grid 33.

As shown, a reference numeral 311 represents a glass anode substrate as a base, 312 a back glass substrate, 313 side glass plates facing to the anode substrate 311 (only one is designated by the reference numeral). The anode substrate 311, the back glass substrate 312 and the side glass plate 313 constitutes a vessel. On the other hands, the vessel may be comprised of three substrates or more. Furthermore, As shown, a reference numeral 33 presents wire grids (only one is designated by the reference numeral) as a linear member, 341, 342 wire grid spacers having rod shape, 36 filaments (only one is designated by the reference numeral) and 37 an anode having an anode electrode and a fluorescent substance formed on the anode electrode. The wire grid 33 has a predetermined vertical position maintained by using the spacers 341, 342 made of insulator, e.g., glass. And, both ends of the wire grid 33 are respectively welded to grid electrodes 321, 322 formed on the glass substrate 311 by using metallic pieces 351, 352. In this case, the ultrasonic bonding is employed. The grid electrodes 321, 322 are made of metal layer, e.g., Al thin film and perform a double duty as a grid terminal or a grid wire for extracting the grid electrode to the outside.

The wire grid spacers 341, 342 may be made of a conductive material, e.g., a metal line. For instance, the wire grid spacers 341, 342 may be the metal line as the filament spacer 143 (a linear spacer) as shown in FIG. 5C, for supporting the grid.

On the other hand, this embodiment may further include metal lines as the damper 180 shown in FIG. 5A.

Figure 7:
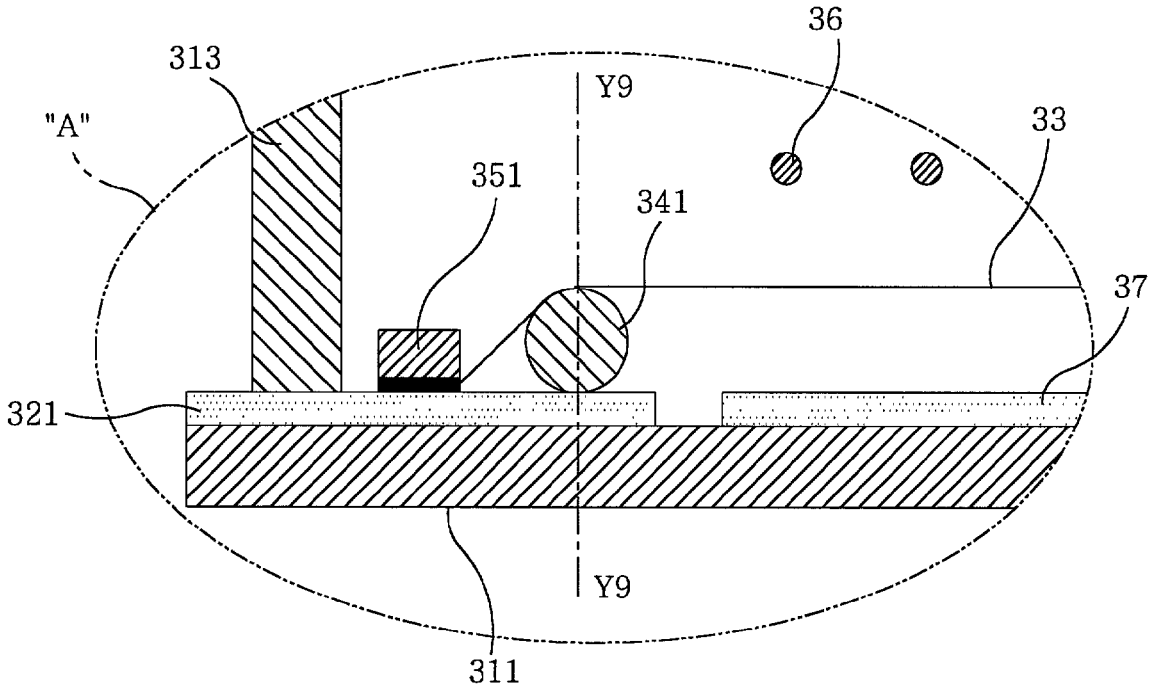
FIG. 7 depicts an expanded view of A part of FIG. 6B.

There is shown in FIG. 7, an expanded view of A part of FIG. 6B, for illustrating the connection of the Al thin film 321 and the wire grid 33.

In the fourth prior art embodiment, the initial position of the wire grid 71 is deviated in sealing process. Further, since the wire grid is extracted from a casing to the outside, the wire grid should be made of the material having a thermal expansion coefficient similar to that of glass. This sets a limit on the material of the wire grid, e.g., 426 alloy (Ni 42%, Cr 6%, the remaining Fe). Additionally, the connection of the wire grid and the printed circuit board such as a drive circuit is achieved by soldering leads to the ends of the wire grid and the terminal of the printed circuit board.

The fifth embodiment solves the problems of this prior art. To be more specific, the wire grid 33 maintains its vertical position by using the spacers 341, 342. Under this condition, both ends of the wire grid 33 are secured to the grid electrodes 321, 322 by using the ultrasonic bonding. As a result, it is possible to preserve the initial position of the wire grid 33 even when the attachment or the sealing thereof is carried out.

Further, since it is not required for the jig or for loading the jig into the heating furnace, the mounting process of the wire grid 33 is simple and it is possible to effectively use the heating furnace.

Since the ends of the wire grid 33 are located within the vacuum casing of the fluorescent display device, it is possible to select the material of the wire grid regardless of the thermal expansion coefficient of glass. Moreover, since the grid electrode 321 is extracted to the outside, it is easy to connect the wire grid 33 to the printed circuit board by using thermo compression bonding.

The term grid electrode used here represents the electrode at which the wire grid is installed and grid wiring used here refers to the terminal or the wiring which is connected to the grid electrode and is extracted to the outside of the display device to function as a power feeding point.

Figure 8A:
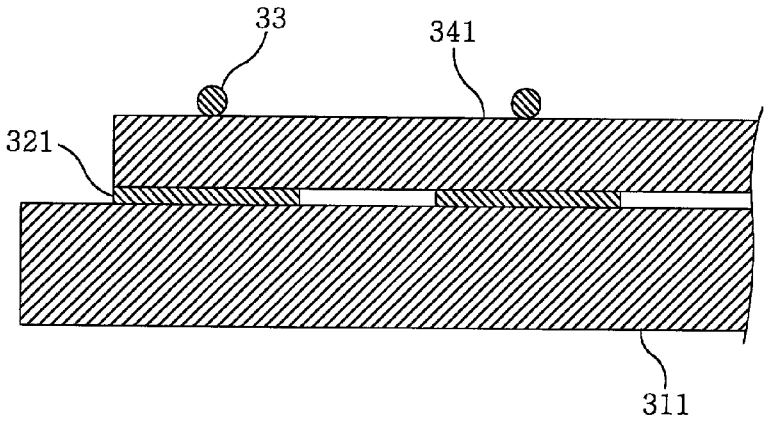
FIGS. 8A to 8C show a partial cross sectional view taken along a line Y9—Y9 of FIG. 7, an example of employing a convexoconcave spacer, and a partial cross sectional view taken along a line Y10—Y10 of FIG. 8B, respectively.

Referring to FIG. 8A showing a partial cross sectional view taken along a line Y9—Y9 of FIG. 7, the spacer 341 is fixedly attached to the grid electrode 321 by using, e.g., the fritted glass.

Figure 8B:
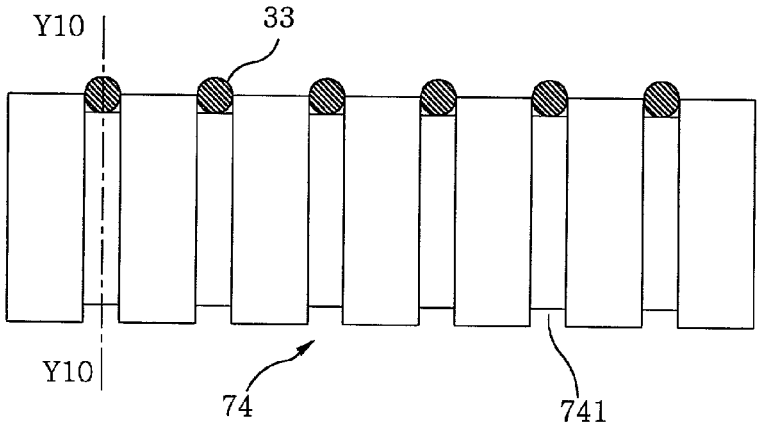
Figure 8C:
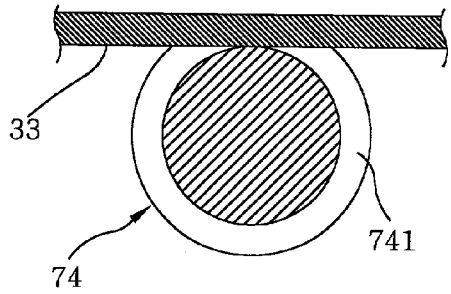

There are shown in FIGS. 8B and 8C, an example of employing a convexoconcave spacer 74 and a partial cross sectional view taken along a line Y10—Y10 of FIG. 8B, respectively.

As shown, the spacer 74 has at its periphery a plurality of recesses 741 (only one is designated by the reference numeral) for accommodating their corresponding wire grids. The recess 741 serves to position the wire grid 33.

The linear members besides the spacer may have a convexoconcave shape. Such a spacer can be employed in the other embodiment.

Although the above discussions refer to the fluorescent display device, identical results can be obtained in an electron tube, for instance, a display tube including a CRT, a discharge tube including a hot cathode discharge lamp and a vacuum tube incorporating therein linear members such as the filaments or the wire grids and the auxiliary supporting members such as the linear spacers or the linear dampers.

Figure 9A:
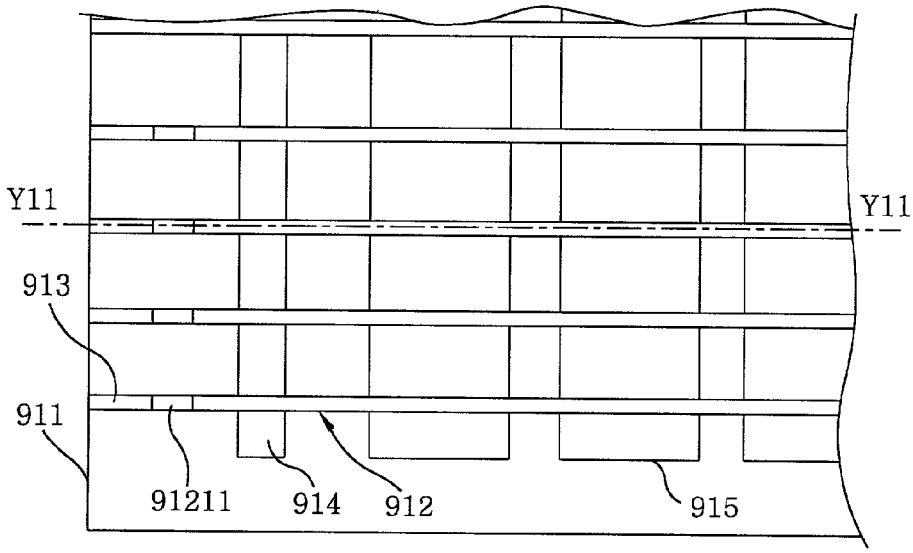
FIGS. 9A to 9C set forth a partial top view of an anode substrate of a display device in accordance with a sixth preferred embodiment of the present invention, a cross sectional view taken along a line Y11—Y11 of FIG. 9A, and a modification of FIG. 9B, respectively.
Figure 9B:
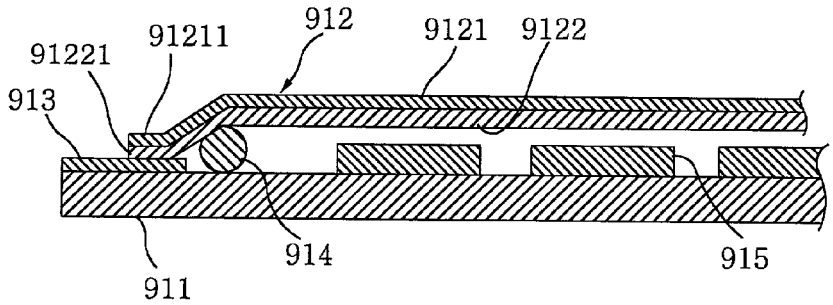

FIGS. 9A and 9B set forth a partial top view of an anode substrate of a display device in accordance with a sixth preferred embodiment of the present invention and a cross sectional view taken along a line Y11—Y11 of FIG. 9A, respectively.

As shown, a reference numeral 911 presents an anode substrate made of an insulator, e.g., glass or ceramic as a base; 912 wire grids (only one is designated by the reference numeral) as a linear support, 913 pads (only one is designated by the reference numeral) made of a metallic layer, e.g., Al; 914 spacers (one shown) made of, e.g., glass fiber; 915 anode electrodes (only one is designated by the reference numeral) having fluorescent substrates thereon.

Referring to FIG. 9B, the wire grid 912 has a YEF 426 alloy (Ni 42%, Cr 6%, the remaining Fe) layer 9121 and an Al cladding or Al layer 9122 formed beneath the YEF 426 alloy layer 9121. The YEF 426 alloy layer 9121 is a basic element of the wire grid that plays a role of the grid and/or a base. The TEF 426 alloy layer as will be described later performs an identical rule. The Al layer 9122 is an additional member to be used for the ultrasonic bonding. The wire grid 912 is coupled to the anode substrate 911 by fixedly attaching one end 91221 of the Al layer 9122 and one end 91211 of the YEF 426 alloy layer 9121 to the Al pad 913.

Although only one side of the wire grid is shown in FIG. 9B, the other thereof is equally connected to another Al pad.

In the connection of the wire grid 912 and the anode substrate 911, the end 91221 of the Al layer 9122 is fixedly attached to the Al film pad 913 by using the ultrasonic bonding. On the other hand, the attachment of the wire grid 912 is performed under the condition of applying the predetermined tension force thereto. In this case, the wire grid 912 maintains its vertical position by the spacers 914.

When the wire grid 912 has pitch of 0.3 mm or more, the end 91211 of the YEF 426 alloy layer 9121 of the wire grid 912 is interposed between the Al pad 913 having a greater width than the line width of the wire grid 912 and the Al wire (not shown) arranged in the cross direction of the wire grid 912 with line width greater than the line width of the wire grid 912 in such a way that the wire grid 912 is enveloped by the Al wire. Under this condition, both ends of the wire grid 912 are secured at the Al pads 913 by using the ultrasonic wire bonding. In this case, the binding strength of the wire grid to the Al pads is improved. This is also suitable to a cathode filament and a wire damper as will be described later.

The wire grid 912 is obtained by cutting a structure, where the YEF 426 alloy layer 9121 is stacked on the Al layer 9122, into a width of 0.05 mm. This cutting process is performed by a suitable cutter, but may be performed by a chemical method, e.g., etching.

Figure 9C:
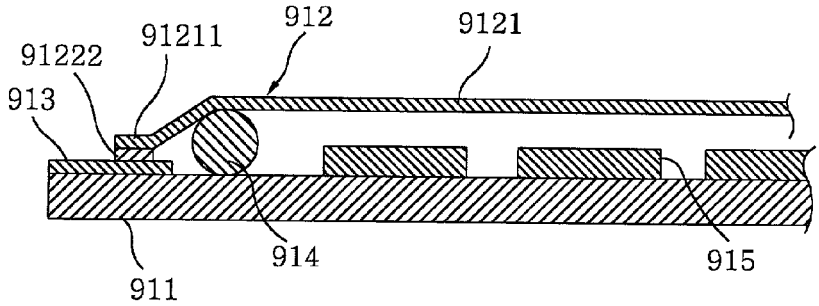

There is shown in FIG. 9C a modification of FIG. 9B in which an Al layer 91222 is provided only under the end 91211 of the YEF 426 alloy layer 9121. The YEF 426 alloy layer 9121 is the basic element. That is, the YEF 426 alloy layer 9121 plays a role of the grid. The Al layer 91222 is an additional member used for the ultrasonic bonding.

Referring to FIGS. 9B and 9C, the wire grid 912 has a width of 0.05 mm, the YEF 426 alloy layer 9121 has a thickness of 0.04 mm, the Al layer 9122 or 91222 has a thickness of 0.01 mm, the Al film pad 913 has a thickness of 1.2 $\mu$m and the wire grid has a pitch of 0.1 mm.

Further, the ultrasonic bonding is performed under the condition of ultrasonic frequency of 38 kHz, power of 200 W, pressing force of, if the bonding area is 0.25 $mm^2$, 11 N, if 1 $mm^2$, 21 N, if 4 $mm^2$, 31 N, bonding time of 0.3 sec., amplitude of 70 V. In any case, the binding strength is equal to or more than 1.5 N of the fracture strength of the wire grid 912. To be more specific, if the binding area is 0.25 $mm^2$, the binding strength is equal to or more than 15 N, if 1 $mm^2$, it is equal to or more than 23 N, if 4 $mm^2$, it is equal to or more than 35 N. Consequently, the binding strength is ten times or more as the fracture strength of the wire grid 912.

In consideration of the thermal expansion coefficient, the strength, the presence and absence of the production of the undesired gas or the like, the YEF 426 alloy is typically used as the material of the components of the fluorescent display device. But, it is difficult to apply the ultrasonic bonding to the YEF 426 alloy. Generally, Al, Cu, Au, Ag, Pt, V, Nb or the like are suitable for the ultrasonic bonding, but Fe or steel plate, particularly alloy made of Ti, Ni, Zr or the like are unsuitable. Since the YEF 426 alloy is made of a group selected from Ni, Fe, Cr, it is unsuitable for the ultrasonic bonding. However, the wire grid 912 in accordance with the embodiment is suitable for the ultrasonic bonding. To be more specific, it is found that, if the wire grid is fabricated by using the Al layer as well as the YEF 426 alloy layer 9121, the resulting wire grid is suitable for the ultrasonic bonding.

Since the wire grid in accordance with this embodiment is suitable for the ultrasonic bonding, there will be no evaporation of the Al pad 913 due to the heat. Therefore, the Al pad can be formed of the thin film. In this case, since the Al pad can be formed by using a small amount of the aluminum, it can be formed in an identical process as the outside extracting wirings of the anode electrode (anode wiring), thereby facilitating the fabrication of the device.

Since the wire grid 912 is fixedly attached by using the ultrasonic bonding, there will be no damages inflicted on other components owing to the heat. Further, since its attachment does not require the fritted glass, it is easy to attach the wire grid 912 and to control or maintain the temperature in the processes subsequent to the attachment process of the wire grid 912 and it is possible to bring down the amount of the undesired gas of contaminating, e.g., the fluorescent substrate.

In this embodiment, the YEF 426 alloy has been employed for wire grid 912, but a stainless steel or the like can be used.

The wire grid (or the linear member) in accordance with this embodiment is divided into a fixed part which is fixedly attached to the grid electrode (or the metallic film) formed on the substrate (or the base) and a body excepting for the fixed part. This is identically suitable for embodiments as will be described later.

Figure 10A:
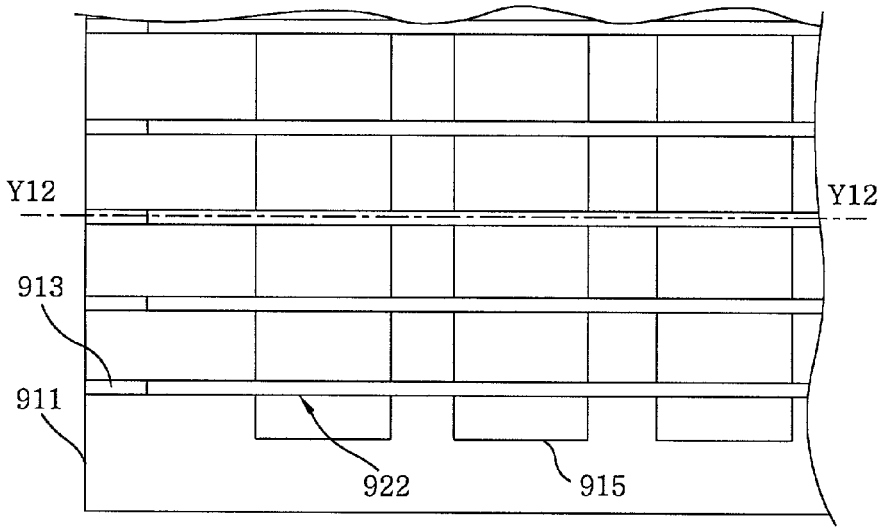
FIGS. 10A to 10C depict a partial top view of an anode substrate of a display device in accordance with a seventh preferred embodiment of the present invention, a cross sectional view taken along a line Y12—Y12 of FIG. 10A, and a modification of FIG. 10B, respectively.
Figure 10B:
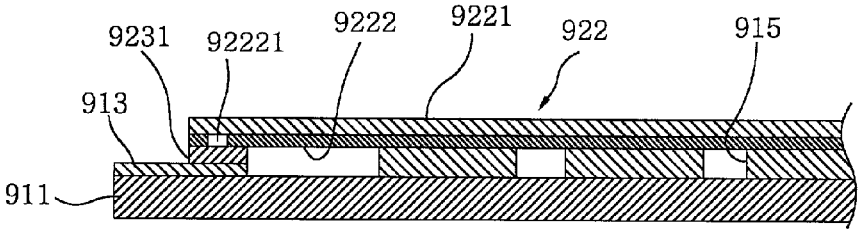

FIGS. 10A and 10B depict a partial top view of an anode substrate 911 of a display device in accordance with a seventh preferred embodiment of the present invention and a cross sectional view taken along a line Y12—Y12 of FIG. 10A, respectively.

As shown, the seventh display device includes a wire grid 922 having an insulating layer 9222 and a YEF alloy layer 9221 on the insulating layer 9222. Between the anode substrate 911 and one end of the wire grid 922, an Al layer 9231 is formed. The insulating layer 9222 is formed by depositing, e.g., ceramic and has a thickness of about 1 to about 2 $\mu$m. Further, the insulating layer 9222 has through-holes 92221 (one shown) between both ends of the YEF alloy layer 9221 and their corresponding Al pads 913, the through-hole 92221 being filled with a conductive material. The YEF 426 alloy 9221 and the insulating layer 9222 are a basic member of the wire grid. The Al layer 9231 is used as an additional member for the ultrasonic bonding. The insulating layer 9222 is provided on the anode electrodes 915 (only one is designated by the reference numeral). The wire grid 922 is fixedly connected to the Al pad 913 by using the ultrasonic bonding.

The YEF 426 alloy layer 9221 and the Al layer 9231 are electrically connected to each other via the conductive material in the through-hole 92221. Otherwise, this connection may be achieved by using conductive material used for coating the YEF 426 alloy layer 9221, the insulating layer 92222, the Al layer 9231 and the Al film pad 913.

After cutting one end of the insulating layer, the Al layer may be formed to be in contact with the YEF 426 alloy layer.

Figure 10C:
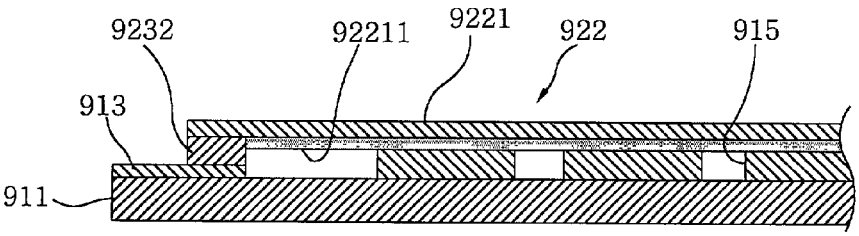

There is shown in FIG. 10C a modification of FIG. 10B, the modification including oxidations 92211 (one shown) as an insulating layer.

The wire grid 922 has the oxidation 92211 at bottom of the YEF 426 alloy layer 9221. The oxidation 92211 is obtained by, firstly forming an oxidation layer to bottom of the YEF 426 alloy layer 9221 and then cutting both ends thereof having a predetermined length therebetween. The Al layers 9232 (one shown) are formed at a location at which the foregoing oxidation layer is cut. The oxidation 92211 may be formed by using, e.g., anodizing. The oxidation 92211 has a thickness of about 5 to about 10 $\mu$m. After cutting work of the oxidation layer, the Al layer 9232 is formed on the YEF 426 alloy layer 9221. The Al layer 9232 is fixedly attached at the Al pad 913 by using the ultrasonic bonding.

On the other hand, without the cutting work of the oxidation layer, the Al layer 9232 may be fixedly attached at the oxidation layer. In this case, the YEF 426 alloy layer 9221 and the Al layer 9232 are electrically connected to each other by using the conductive material.

In this embodiment, the wire grid 922 is directly overlapping with the anode electrode 915, thereby making the fluorescent display panel thin. Further, the vibration of the wire grid is prevented which in turn reduces its pitch, facilitating the device miniaturization.

As the basic element of the wire grid 922, the stainless steel may be employed.

Figure 11A:
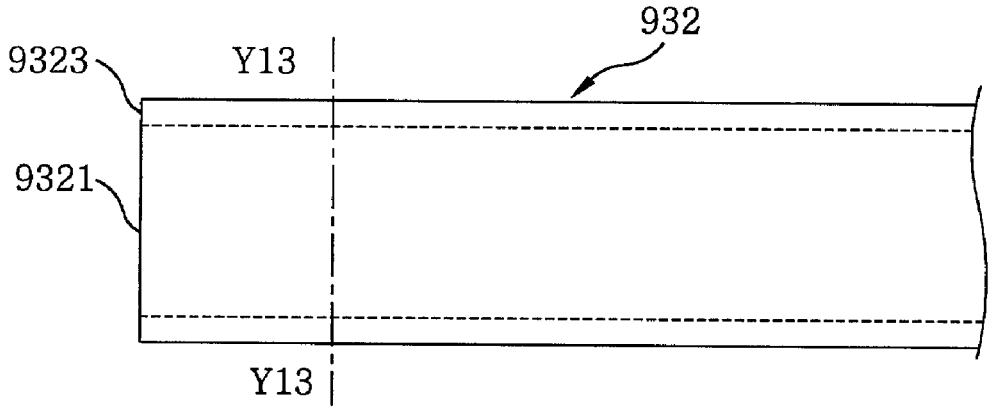
FIGS. 11A and 11B illustrate a partial side view of a wire grid of a display device in accordance with an eighth preferred embodiment of the present invention and a cross sectional view taken along a line Y13—Y13 of FIG. 11A, respectively.
Figure 11B:
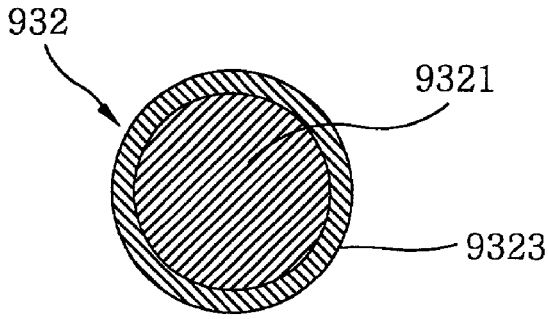

FIGS. 11A and 11B depict a partial side view of a wire grid 932 of a display device in accordance with an eighth preferred embodiment of the present invention and a cross sectional view taken along a line Y13—Y13 of FIG. 11A, respectively.

As shown, the wire grid 932 has a YEF alloy wire 9321 and an Al layer 9323 deposited on the periphery of the YEF alloy wire 9321 by using a vacuum evaporation. The wire 9321 is a basic element of the wire grid 932, and the Al layer 9323 is an additional element for the ultrasonic bonding. The YEF alloy wire 9321 has a diameter of, e.g., about 50 $\mu$m and the Al layer 9323 has a thickness of, e.g., about 2 $\mu$m. The attachment of the wire grid 932 is achieved by using, e.g., the ultrasonic bonding.

Since the wire grid 932 has in its whole periphery the Al layer 9323, it is possible to stick the wire grid 932 to the Al pad free from the binding direction.

As the basic element of the wire grid 932, the stainless steel may be employed instead of the YEF 426 alloy.

Figure 12A:
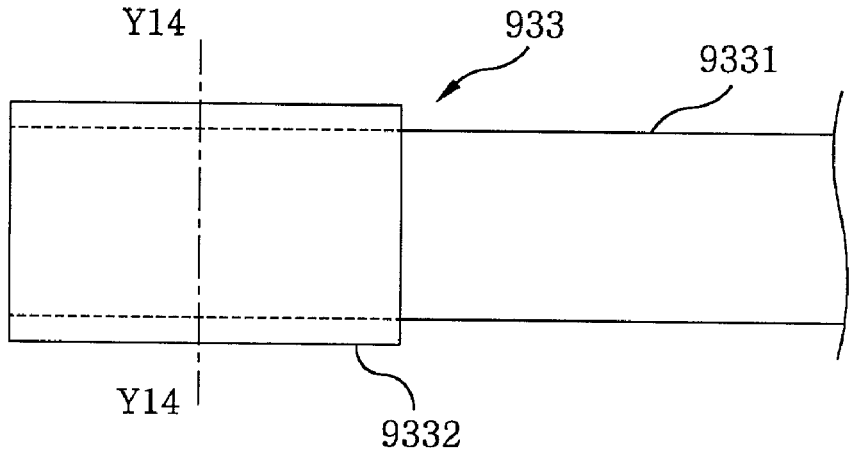
FIGS. 12A and 12B depict a partial side view of a wire grid of a display device in accordance with a ninth preferred embodiment of the present invention and a cross sectional view taken along a line Y14—Y14 of FIG. 12A, respectively.
Figure 12B:
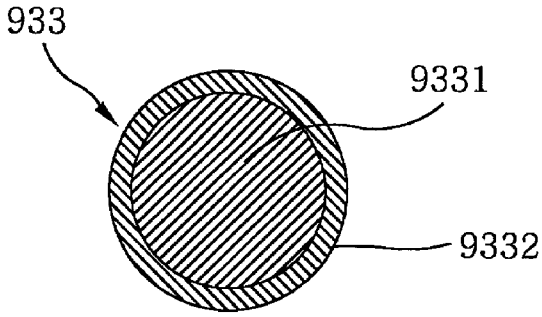

FIGS. 12A and 12B depict a partial side view of a wire grid 933 of a display device in accordance with a ninth preferred embodiment of the present invention and a cross sectional view taken along a line Y14—Y14 of FIG. 12A, respectively.

As shown, the wire grid 933 has a YEF alloy wire 9331 and an Al layer 9332 deposited on the periphery of an end of the YEF alloy wire 9331 by using a vacuum evaporation.

The wire 9331 is a basic element of the wire grid 933, and the Al layer 9332 is an additional element for the ultrasonic bonding.

Although the wire grid 933 has only at its end the Al layer 9332, it is also possible to stick the wire grid 933 to the Al pad free from the binding direction.

As the basic element of the wire grid 933, the stainless steel may be employed instead of the YEF 426 alloy.

Figure 13A:
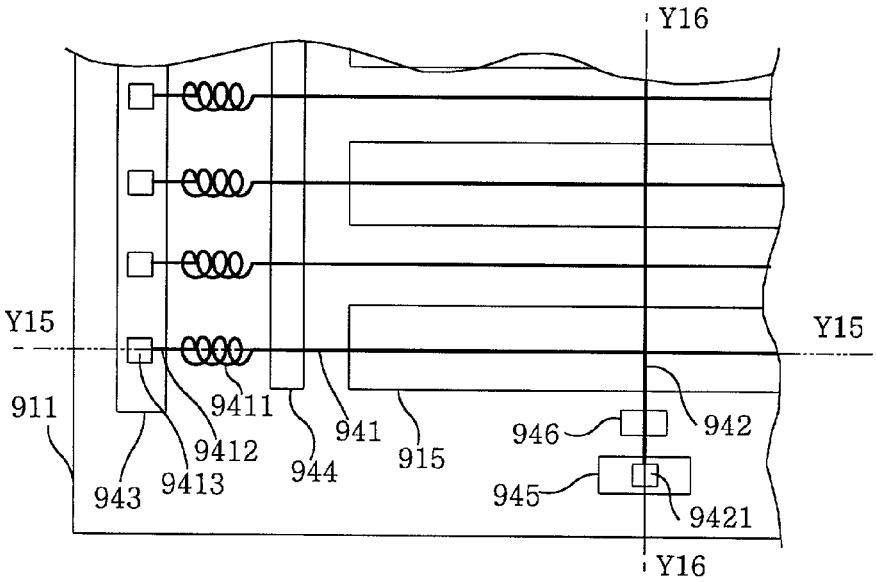
FIGS. 13A to 13C set forth a partial top view of an anode substrate of a display device in accordance with a tenth preferred embodiment of the present invention, a cross sectional view taken along a line Y15—Y15 of FIG. 13A, and a cross sectional view taken along a line Y16—Y16 of FIG. 13A, respectively.
Figure 13B:
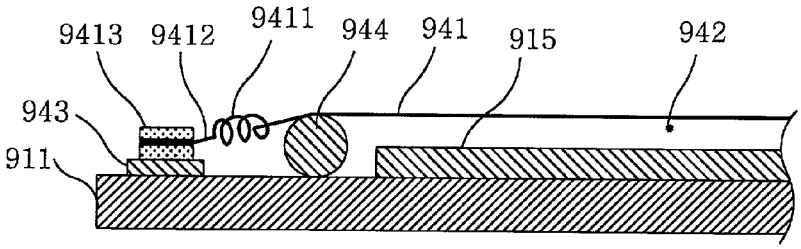

FIGS. 13A and 13B set forth a partial top view of an anode substrate of a display device in accordance with a tenth preferred embodiment of the present invention and a cross sectional view taken along a line Y15—Y15 of FIG. 13A, respectively.

As shown, a reference numeral 941 presents cathode filaments (only one is designated by the reference numeral), 9411 a tension force applying portion(only one is designated by the reference numeral), e.g., a coil portion for exerting a predetermined tension force on the filament 941; 943 filament Al pads; and 944 filament spacers (one shown) made of, e.g., glass or metal.

The filament 941 has a core wire made of a tungsten or tungsten alloy and carbonate for electron emission deposited on the periphery of the core wire. On the other hand, a filament Al film 9413 is formed at one end 9412 of the filament 941 with a thickness of about 2 $\mu$m to envelope the end 9412 by using the ultrasonic bonding (that is, the Al film 9413 has an identical structure as the Al layer 9332 as shown in FIG. 12B). Furthermore, after eliminating carbonate of the end 9412 of the filament 941, the Al film 9413 is formed thereon exposed, but without the elimination, may be formed thereon. But, the binding strength is greater in the former.

The filament 941 is connected to the anode substrate 911 by bonding both ends 9412 (only one is designated by the reference numeral) thereof to the anode substrate 911. For instance, one end 9412 of the filament 941 is bonded to the anode substrate 911 by ultrasonic-welding the filament Al film 9413 to the filament Al pad 943. Similarly, the other end (not shown) of the filament 941 is also bonded to the anode substrate 911. The filament 941 has a predetermined vertical position sustained by using the filament spacers 944 (one shown). The spacers 944 have a circular shape in a section, but as long as it is possible to tightly maintain the wires, its shape is not restricted to the circular shape in a section.

The filament 941 is thermally expanded owing to the heat generated in driving the fluorescent display device. The coiled portion 9411 serves to apply a predetermined tension force on the filament 941 in response to the change in the length thereof. The tension force applying portion is not limited to the coiled shape as long as it is possible to apply the tension force.

Figure 13C:
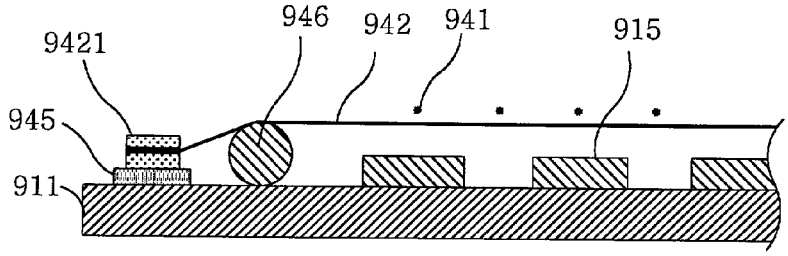
Figure 14A:
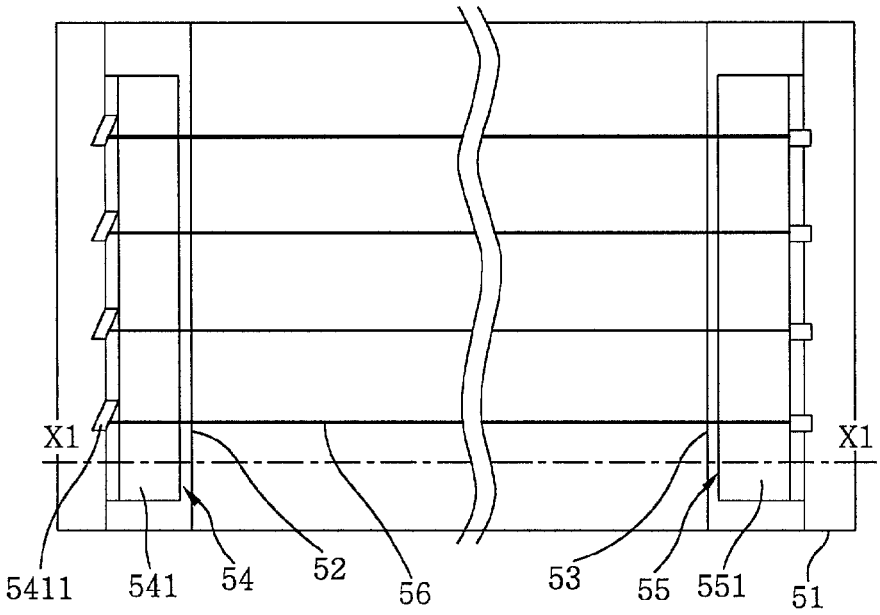
FIG. 14A (PRIOR ART)
FIGS. 14A and 14B are a partial top view of a first prior art fluorescent display device and a cross sectional view taken along a line X1—X1 of FIG. 14A, respectively.
Figure 14B:
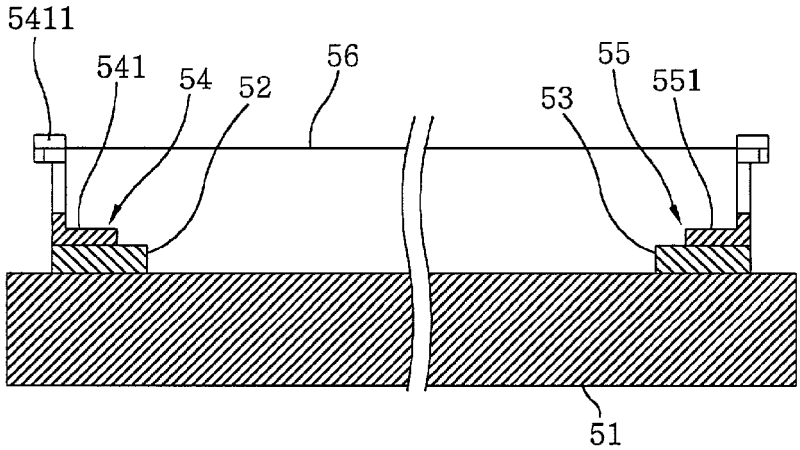
FIG. 14B (PRIOR ART)
Figure 15A:
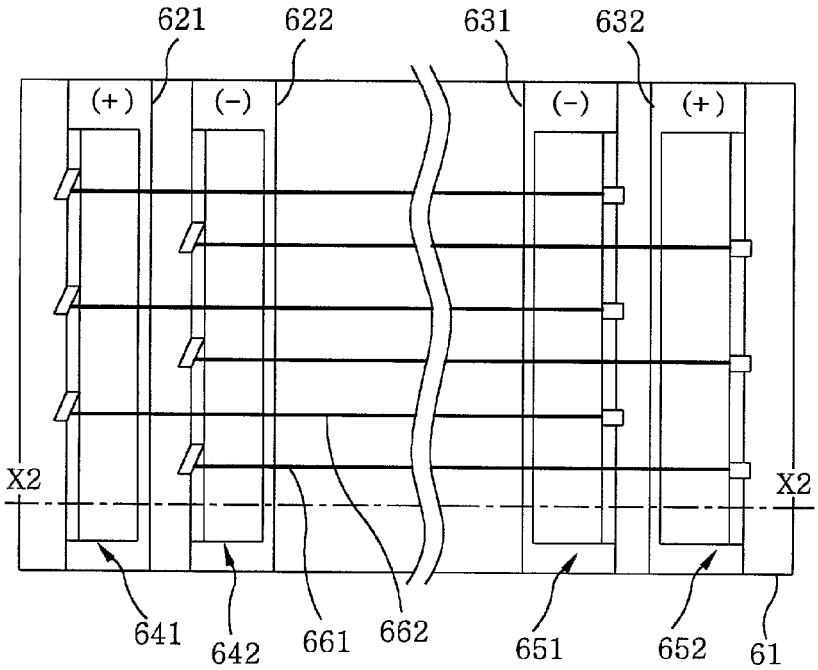
FIG. 15A (PRIOR ART)
FIGS. 15A and 15B illustrate a partial top view of a second prior art fluorescent display device and a cross sectional view taken along a line X2—X2 of FIG. 15A, respectively.
Figure 15B:
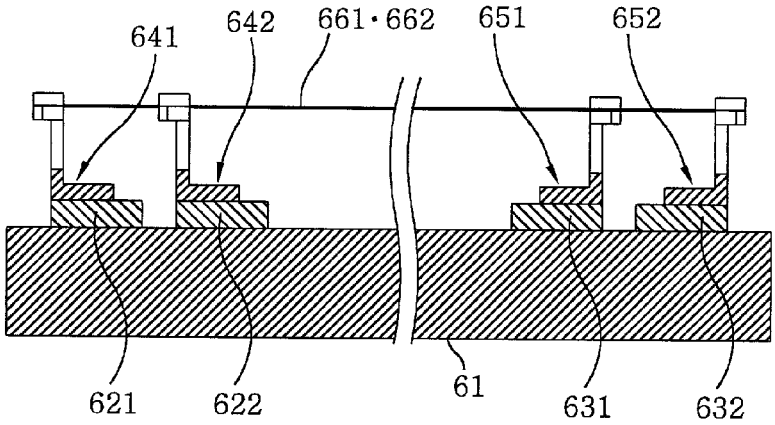
FIG. 15B (PRIOR ART)
Figure 16A:
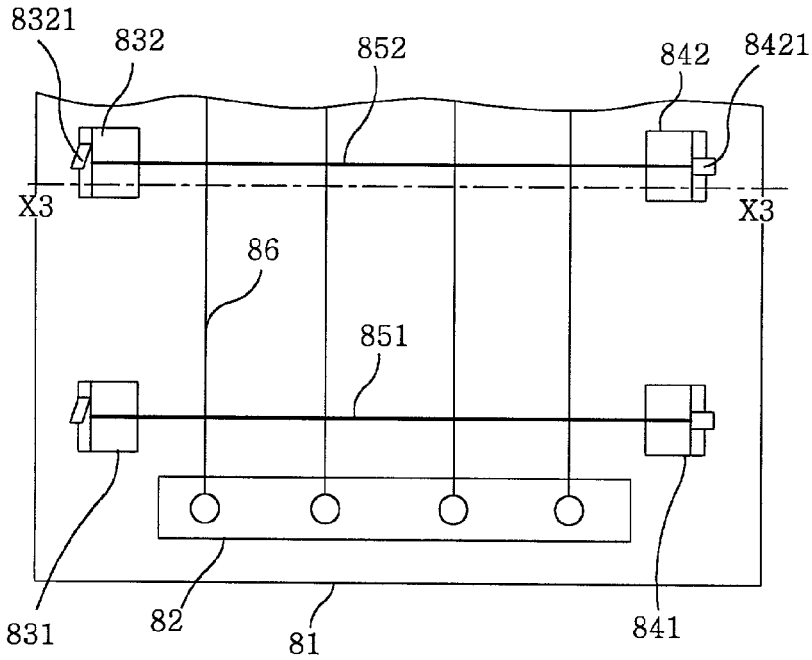
FIG. 16A (PRIOR ART)
FIGS. 16A and 16B present a partial top view of a third prior art display device including linear spacers, a damper and filaments and a cross sectional view taken along a line X3—X3 of FIG. 16A, respectively.
Figure 16B:
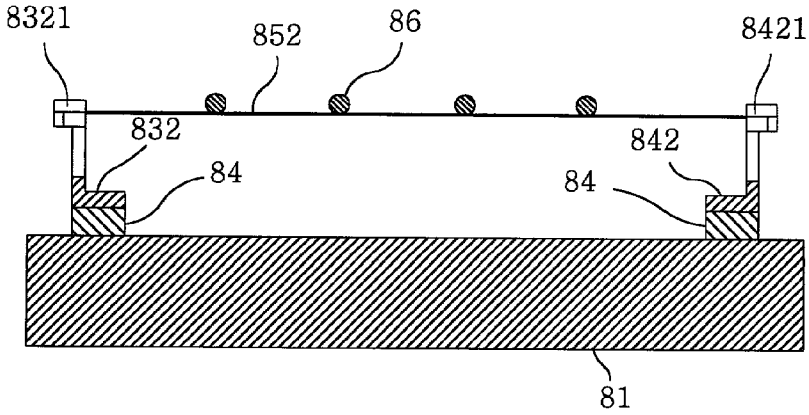
FIG. 16B (PRIOR ART)
Figure 17A:
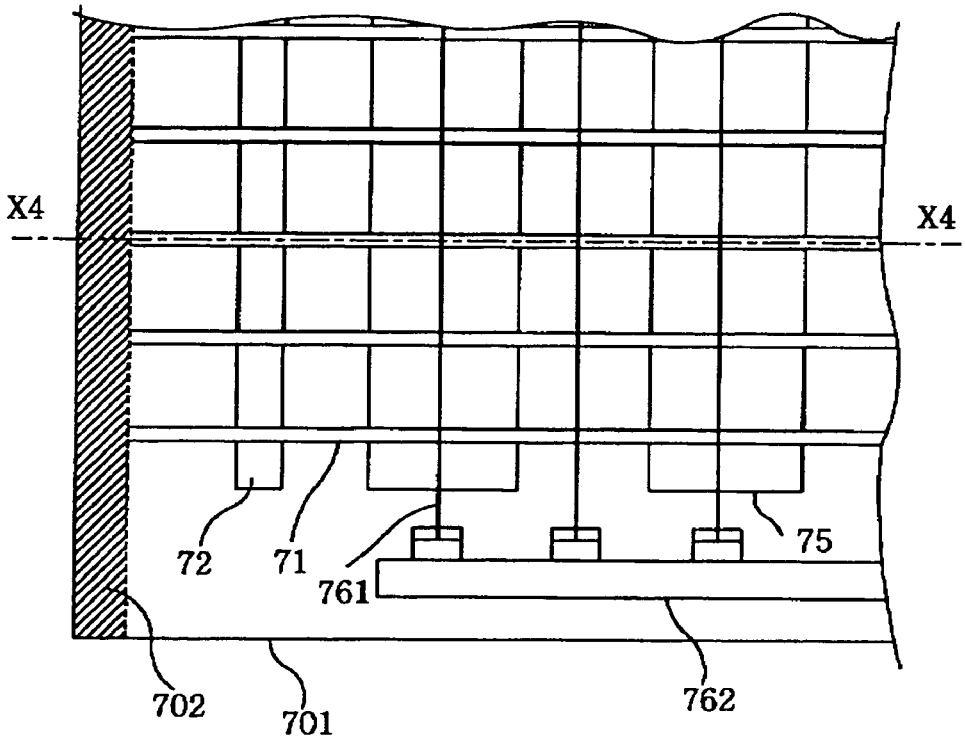
FIG. 17A (PRIOR ART)
FIGS. 17A to 17C represent a partial top view of a fourth prior art display device including wire grids, a cross sectional view taken along a line X4—X4 of FIG. 17A, and a cross sectional view of a modification of the display device of FIG. 17B, respectively.
Figure 17B:
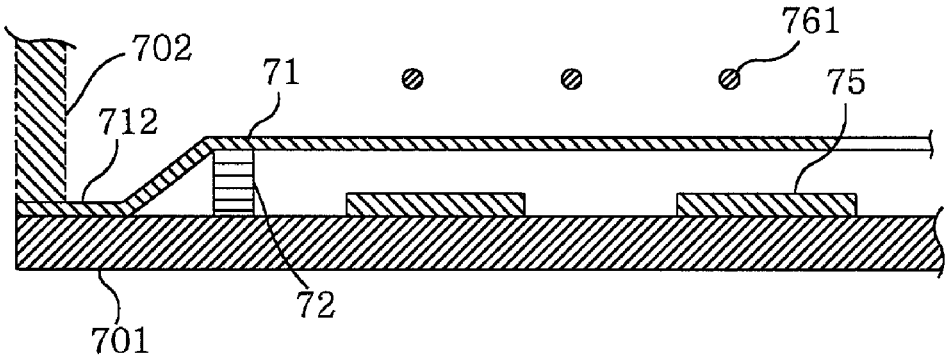
FIG. 17B (PRIOR ART)
Figure 17C:
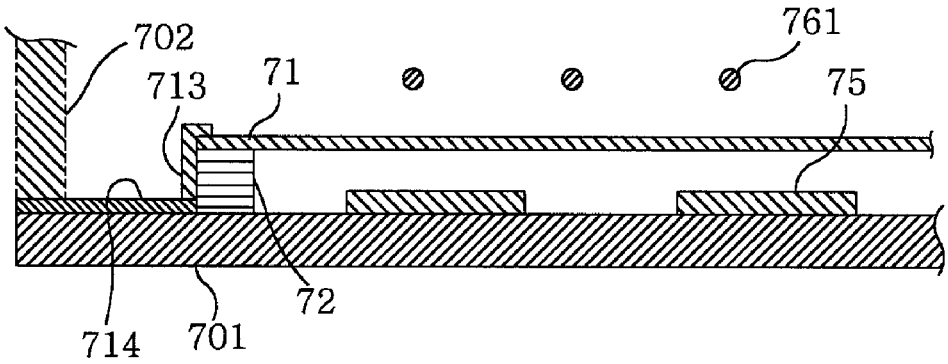
FIG. 17C (PRIOR ART)

Referring to FIG. 13C illustrating a cross sectional view taken along a line Y16—Y16 of FIG. 13A, a reference numeral 942 illustrates a damper; 945 a damper Al pad; 9421 a damper Al film; 946 a damper spacer. The damper 942 is made of metal line of, e.g., W, Mo, stainless. One end of the damper 942 is provided with a damper Al film 9421 as an auxiliary member for the ultrasonic bonding. The damper 942 is installed at the anode substrate 911 by ultrasonic-bonding the damper Al film 9421 to the damper Al pad 945. Similarly, the other end (not shown) of the damper 942 is stuck to the anode substrate 911 having anode electrode 915. The connection of the damper 942 to the anode substrate 911 is performed under the condition of applying the predetermined tension force to the damper 942. Further, since the damper 942 is not heated in driving the fluorescent display device, it is not required for members like the coiled portion 9411 of the filament 941.

The spacer 946 has a circular shape in a section but, as long as it is possible to tightly maintain the wires, its shape in a section is not limited to the circular shape.

The Al film may cover not only the ends of the damper but also the remaining portion thereof. Further, the Al film may be formed in such a way that only a portion of the ends of the damper is covered therewith.

In this embodiment, only by including the Al film to the basic elements of the filament or the damper, it is found that the bonding work of the filament or the damper can be achieved by using the ultrasonic bonding.

The filament damper may be used to perform a double duty as a spacer for defining the vertical position of the filament. That is, it can be used as an auxiliary linear member for supporting the cathode.

Further, the filament damper may be used to perform a double duty as a grid damper or a spacer for defining the vertical position of the grid. In other words, it can be used for an auxiliary linear member for supporting the grid.

In foregoing embodiments, the Al films or the Al pads provided on the anode substrate may be formed of the thin film or the thick film (formed by using, e.g., the screen printing) Further, the Al films may be formed on the metallic components. Otherwise, the metallic components may be made of an Al. That is, the metal films may be separately formed on the base or may be formed to be integral with the base.

The additional members for the ultrasonic bonding and the pad or the film therefor formed on the anode substrate may be made of materials beside the Al, e.g., copper, silver, gold, white gold, niobium, vanadium or the like. In this case, the additional members and the pad or the film may be made of different materials from each other, but when they are made of an identical material to each other, the bonding strength therebetween is best.

The linear members such as the wire grids, the filaments, the dampers or the spacers may be formed on a front substrate opposing the anode substrate. It is also possible that they are partially formed on the anode substrate and the remaining is formed on the front substrate. On the other hand, they may be formed on the side plate. That is, they may be formed on either the package constituting the electron tube or any component of the electron tube.

Although the above discussions are presented referring to a situation where the linear members such as the wire grids, the filaments, the dampers or the spacers may be formed on the anode substrate formed on the base, the same method may be adopted to other linear members, e.g., a getter electrode for wire getters.

The wire getter is classified into a volatile wire getter or a non-volatile wire getter.

The volatile wire getter is integrally formed on the metal line, e.g., recess of the metal line. The volatile wire getter is selectively heated by using a laser beam or an infrared ray. The heat evaporates a getter material to form a getter film on the container of the electron tube, obtaining a gas absorption feature. Further, by electrifying the getter electrode, it is possible to obtain a gas absorption feature.

Non-volatile wire getter has as its major component, for example, a linear Zr—Al alloy, a linear Zr—Fe alloy, a linear Zr—Ni alloy, a linear Zr—Nb—Fe alloy, a linear Zr—Ti—Fe alloy, a linear Zr—V—Fe alloy or the like. Moreover, non-volatile wire getter may be formed on the metal line made of metal besides the foregoing metal. By selectively eradiating a laser beam or an infrared ray to the non-volatile getter until the getter reaches an activation temperature, the non-volatile getter is activated, obtaining a gas absorption feature. Further, by electrifying the getter electrode up to an activation temperature, it is possible to obtain a gas absorption feature. On the other hand, non-volatile getter may be formed at a side plate. That is, non-volatile getter may be formed at a package or other components of the electron tube.

Although the above discussions refer to a situation where the fluorescent display device includes a cathode filament, the dampers or the spacers, the present invention can be applied to a fluorescent display device for providing electrons under an electric field, a fluorescent radiation device such as a fluorescent radiation device for use in a printer head using the principle of the fluorescent display device, a radiation device for a large screen display apparatus, a CRT, a plasma display or the like.

While the present invention has been described with respect to certain preferred embodiments only, other modifications and variations may be made without departing from the scope of the present invention as set forth in the following claims.

What is claimed is:

1. An electron tube comprising:

at least one metal film formed on a base;

at least one linear member provided above the base, wherein at least a part of said at least one linear member is a tension force applying portion for exerting a tension force;

at least one spacer for defining a distance between said at least one linear member and the base; and at least one additional member for connecting one end of said at least one linear member to said at least one metal film, wherein said at least one additional member is welded to a portion of said at least one metal film, said one end of said at least one linear member being disposed between said at least one additional member and said at least one metal film, and the entire portion of said at least one metal film being in direct contact with the base.

2. The electron tube of claim 1, wherein said at least one additional member is at least one metal piece, and on the condition of interposing said at least linear member between said at least one metal piece and said at least one metal film, said at least one linear member is fixedly attached to said at least one metal film by welding said at least one metal piece to at least one metal film.

3. The electron tube of claim 1, wherein said at least one additional member is independently provided to said at least one linear member.

4. The electron tube of claim 1, wherein said at least one linear member is a grid and said at least one metal film is a grid electrode.

5. The electron tube of claim 1, wherein said at least one linear member is a cathode, and said at least one metal film is a cathode electrode.

6. The electron tube of claim 1, wherein said at least one linear member serves to support a cathode, a grid or a getter.

7. The electron tube of claim 1, wherein said at least one metal film is formed in a thin film.

8. The electron tube of claim 1, wherein the attachment of said at least one linear member is achieved by using an ultrasonic bonding.

9. The electron tube of claim 1, wherein said at least one metal film and said at least one additional member are made of the same metallic material to each other.

10. The electron tube of claim 1, wherein the electron tube is a fluorescent radiation tube.

11. The electron tube of claim 10, wherein said at least one spacer is made of a conductive material disposed on said at least one metal film.

12. The electron tube of claim 1, further comprising a vessel including at least two substrates, and the base being the vessel.

13. The electron tube of claim 1, wherein said one end of said at least one linear member is directly connected to said at least one metal film by welding said at least one additional member to said one end of said at least one linear member located on said at least one metal film.

14. The electron tube of claim 1, wherein the tension force applying portion has coiled shape.

15. An electron tube comprising:

at least one metal film formed on a base;

at least one linear member provided above the base and divided into a body portion and a fixture portion for fixedly attaching the body portion to said at least one metal film, wherein at least a part of said at least one linear member is a tension force applying portion for exerting a tension force;

at least one spacer for defining a distance between said at least one linear member and the base; and at least one additional member, for fixedly connecting the fixture portion to said at least one metal film, wherein said at least one additional member is welded to said at least one metal film, the distance between the fixture portion of said at least one linear member and the base or the distance between said at least one additional member and the base being not greater than the thickness of said at least one metal film.

16. The electron tube of claim 15, wherein said at least one linear member is a grid having a first and a second metallic member, and the second metallic member of the grid is said at least one additional member.

17. The electron tube of claim 15, wherein said at least one linear member is a grid having a metallic member and an insulating member.

18. The electron tube of claim 5, wherein said at least one linear member is a grid and said at least one metal film is a grid electrode.

19. An electron tube comprising:

at least one metal film formed on a base;

at least one linear member provided above the base, wherein at least a part of said at least one linear member is a tension force applying portion for exerting a tension force;

at least one spacer for defining a distance between said at least one linear member and the base; and at least one additional member for connecting one end of said at least one linear member to said at least one metal film, wherein said at least one metal film includes a generally flat part, the entire flat part of said at least one metal film having two opposite surfaces, said at least one additional member being welded to one of the opposite surfaces wherein said one end of said at least one linear member is connected to said at least one metal film at the same position where said at least one additional member is welded to said one of the opposite surfaces, and the other opposite surface being substantially parallel with and in direct contact with the base.

* * * * *